US010831119B2

(12) United States Patent
Tsurumi et al.

(10) Patent No.: US 10,831,119 B2
(45) Date of Patent: Nov. 10, 2020

(54) ELECTROSTATIC-IMAGE DEVELOPER AND PROCESS CARTRIDGE

(71) Applicant: FUJI XEROX CO., LTD., Tokyo (JP)

(72) Inventors: Yosuke Tsurumi, Kanagawa (JP); Yasuaki Hashimoto, Kanagawa (JP); Hiroaki Saijo, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/539,461

(22) Filed: Aug. 13, 2019

(65) Prior Publication Data

US 2020/0301302 A1 Sep. 24, 2020

(30) Foreign Application Priority Data

Mar. 22, 2019 (JP) ..... 2019-054849

(51) Int. Cl.

| | |
|---|---|
| ***G03G 9/08*** | (2006.01) |
| ***G03G 9/107*** | (2006.01) |
| ***G03G 9/087*** | (2006.01) |
| ***G03G 21/18*** | (2006.01) |
| ***G03G 9/113*** | (2006.01) |

(52) U.S. Cl.

CPC ..... *G03G 9/1075* (2013.01); *G03G 9/08711* (2013.01); *G03G 9/08755* (2013.01); *G03G 9/1136* (2013.01); *G03G 9/1138* (2013.01); *G03G 21/1814* (2013.01)

(58) Field of Classification Search

CPC ..... G03G 9/1075; G03G 9/1136

USPC ..... 430/111.35

See application file for complete search history.

(56) References Cited

U.S. PATENT DOCUMENTS

2004/0253529 A1* 12/2004 Baba ..... G03G 9/1139 430/111.35

2013/0244159 A1* 9/2013 Ishigami ..... G03G 9/0827 430/106.2

FOREIGN PATENT DOCUMENTS

| | | |
|---|---|---|
| JP | 2006-171692 A | 6/2006 |
| JP | 2010-156967 A | 7/2010 |
| JP | 2012-233982 A | 11/2012 |

OTHER PUBLICATIONS

"Test methods for density and relative density of chemical products" Japnese Industrial Standard, JIS K 0061: 2001, 2001, 106 pages.

"Testing Methods for Transition Temperatures of plastics", Japanese Industrial Standard, JIS K 7121-1987, 1987, 26 pages.

* cited by examiner

*Primary Examiner* — Mark A Chapman

(74) *Attorney, Agent, or Firm* — Sughrue Mion, PLLC

(57) ABSTRACT

An electrostatic-image developer includes a toner and a resin-coated carrier. The toner includes toner particles including a binder resin, a release agent, and a non-ionic surfactant. The resin-coated carrier includes magnetic particles and a resin layer covering the magnetic particles. The resin-coated carrier has an absolute specific gravity of 3 g/cm$^3$ or more and 4 g/cm$^3$ or less.

9 Claims, 2 Drawing Sheets

ELECTROSTATIC-IMAGE DEVELOPER AND PROCESS CARTRIDGE

CROSS-REFERENCE TO RELATED APPLICATIONS

This application is based on and claims priority under 35 USC 119 from Japanese Patent Application No. 2019-054849 filed Mar. 22, 2019.

BACKGROUND

(i) Technical Field

The present disclosure relates to an electrostatic-image developer and a process cartridge.

(ii) Related Art

Japanese Unexamined Patent Application Publication No. 2006-171692 discloses a method for producing an electrophotographic toner, the method including forming primary particles that include a binder resin and a colorant in an aqueous medium in the presence of a non-ionic surfactant and performing aggregation and coalescence of the primary particles.

Japanese Unexamined Patent Application Publication No. 2012-233982 discloses a method for producing an electrophotographic toner, the method including preparing an aqueous liquid mixture that includes aggregated particles including resin particles and release agent particles and a non-ionic surfactant and, after and/or while adjusting the pH of the aqueous liquid mixture at 25° C. to be 2.5 to 5.5, performing fusion of the aggregated particles included in the aqueous liquid mixture.

Japanese Unexamined Patent Application Publication No. 2010-156967 discloses an electrostatic-image developing toner that includes a surfactant, a binder resin, and a wax, the surfactant including a non-ionic surfactant having a hydrophilic-lipophilic balance (HLB) of less than 5.

SUMMARY

Aspects of non-limiting embodiments of the present disclosure relate to an electrostatic-image developer capable of reducing the difference between the densities of images formed at different speeds compared with an electrostatic-image developer that includes a toner and a resin-coated carrier, the toner including toner particles that include a binder resin, a release agent, and a non-ionic surfactant, the resin-coated carrier including magnetic particles and a resin layer that covers the magnetic particles, the resin-coated carrier having an absolute specific gravity of more than 4 g/cm$^3$.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided an electrostatic-image developer including a toner and a resin-coated carrier. The toner includes toner particles that include a binder resin, a release agent, and a non-ionic surfactant. The resin-coated carrier includes magnetic particles and a resin layer covering the magnetic particles. The resin-coated carrier has an absolute specific gravity of 3 g/cm$^3$ or more and 4 g/cm$^3$ or less.

BRIEF DESCRIPTION OF THE DRAWINGS

Exemplary embodiments of the present disclosure will be described in detail based on the following figures, wherein.

DETAILED DESCRIPTION

Figure 1:
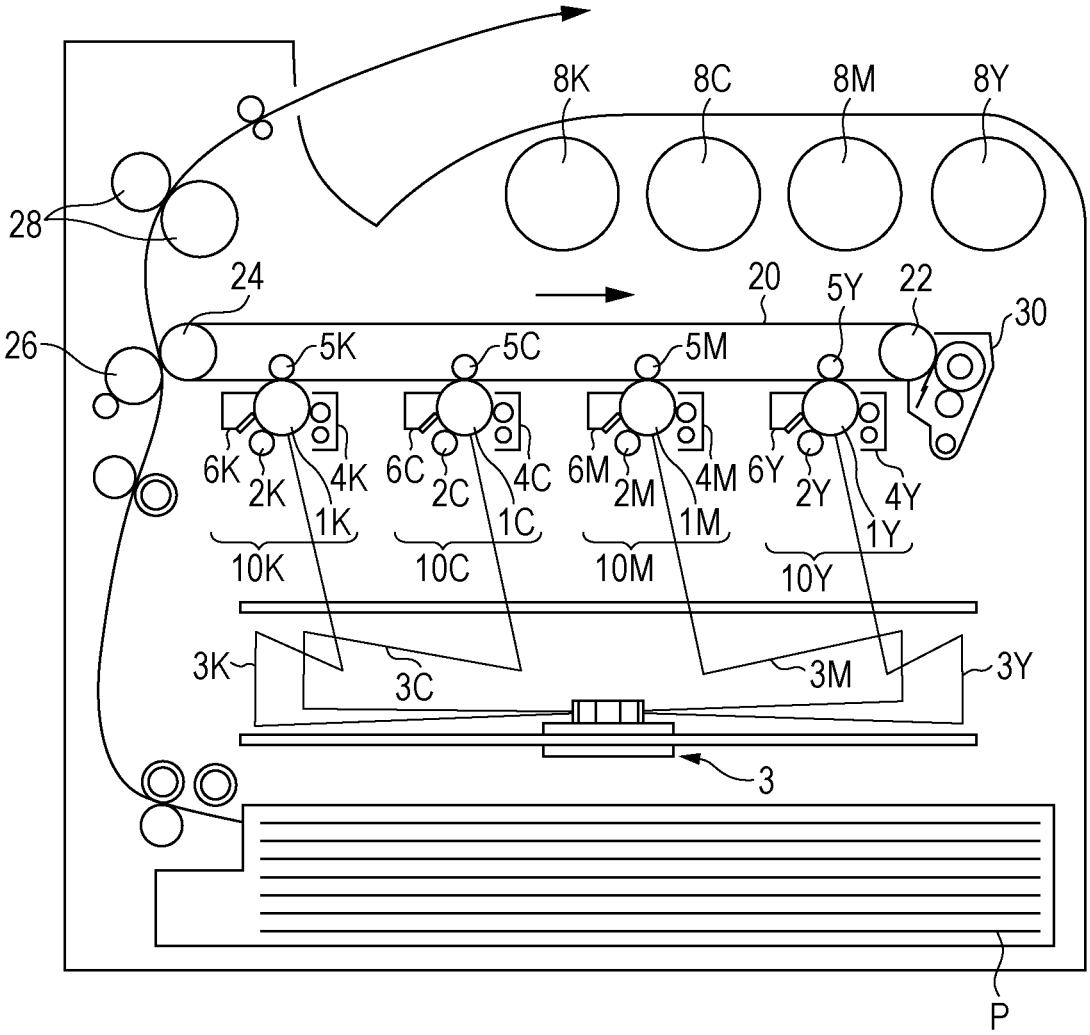
FIG. 1 is a schematic diagram illustrating an example of an image forming apparatus according to an exemplary embodiment.

Exemplary embodiments of the present disclosure are described below. The following description and Examples below are intended to be illustrative of the exemplary embodiments and not restrictive of the scope of the exemplary embodiments.

In the present disclosure, a numerical range expressed using "to" means the range specified by the minimum and maximum described before and after "to", respectively.

In the present disclosure, when numerical ranges are described in a stepwise manner, the upper or lower limit of a numerical range may be replaced with the upper or lower limit of another numerical range, respectively. In the present disclosure, the upper and lower limits of a numerical range may be replaced with the upper and lower limits described in Examples below.

The term "step" used herein refers not only to an individual step but also to a step that is not distinguishable from other steps but achieves the intended purpose of the step.

In the present disclosure, when an exemplary embodiment is described with reference to a drawing, the structure of the exemplary embodiment is not limited to the structure illustrated in the drawing. The sizes of the members illustrated in the attached drawings are conceptual and do not limit the relative relationship among the sizes of the members.

Each of the components described in the present disclosure may include plural types of substances that correspond to the component. In the present disclosure, in the case where a composition includes plural substances that correspond to a component of the composition, the content of the component in the composition is the total content of the plural substances in the composition unless otherwise specified.

In the present disclosure, the number of types of particles that correspond to a component may be two or more. In the case where a composition includes plural types of particles that correspond to a component of the composition, the particle size of the component is the particle size of a mixture of the plural types of particles included in the composition unless otherwise specified.

The term "(meth)acryl" used herein refers to both "acryl" and "methacryl".

In the present disclosure, an electrostatic-image developing toner is referred to simply as "toner", and an electrostatic-image developer is referred to simply as "developer".

Electrostatic-Image Developer

The developer according to the exemplary embodiment includes a toner and a resin-coated carrier. The toner includes toner particles that include a binder resin, a release agent, and a non-ionic surfactant. The resin-coated carrier includes magnetic particles and a resin layer covering the magnetic particles. The resin-coated carrier has an absolute specific gravity of 3 g/cm$^3$ or more and 4 g/cm$^3$ or less. The toner may include an external additive deposited on the toner particles.

The developer according to the exemplary embodiment may reduce the difference between the densities of images formed at different speeds compared with an electrostatic-image developer in which the resin-coated carrier has an absolute specific gravity of more than 4 g/cm$^3$. The mechanisms are presumably as follows.

When an image is formed in a recording medium, the larger the thickness of the recording medium or the lower the thermal conductivity of the recording medium, the larger the amount of time during which a fusing member is brought into contact with the recording medium, in order to transfer a sufficient amount of heat to a toner deposited on the recording medium. Accordingly, the larger the thickness of the recording medium or the lower the thermal conductivity of the recording medium, the lower the speed at which an image is formed on the recording medium. When the speed of formation of an image is reduced, the rotation speed of the developing apparatus is reduced accordingly. In such a case, the density of a developer deposited on the sleeve of the developing apparatus may vary due to the change in the rotation speed of the developing apparatus and, consequently, the state of the magnetic brush may change. This may result in the difference between the densities of images formed at different speeds.

As a result of extensive studies conducted by the inventors of the present disclosure, it was found that the difference in image density may be reduced by using toner particles that include a non-ionic surfactant in combination with a resin-coated carrier having an absolute specific gravity of 3 g/cm$^3$ or more and 4 g/cm$^3$ or less. It is considered that particles of a non-ionic surfactant, which has a high affinity for a release agent compared with a binder resin, are present at the interfaces between binder resin particles and release agent particles so as to surround the release agent particles. It is considered that, upon toner particles being stirred in a developing apparatus and pressurized, the release agent particles vibrate inside the toner particles, and the vibration causes the non-ionic surfactant particles to migrate onto the surfaces of the toner particles and adhere onto the surfaces of the resin-coated carrier particles. When an adequate amount of non-ionic surfactant is present on the surfaces of the resin-coated carrier particles, the state of the magnetic brush is likely to become stable and is not likely to vary with the rotation speed of the developing apparatus. When the resin-coated carrier has an absolute specific gravity of 3 g/cm$^3$ or more and 4 g/cm$^3$ or less, an adequate pressure may be applied to the toner particles when the toner particles are stirred in the developing apparatus and, consequently, an adequate amount of non-ionic surfactant may migrate onto the surfaces of the toner particles and adhere onto the surfaces of the resin-coated carrier particles. In such a case, the state of the magnetic brush is likely to become stable and, as a result, the difference between the densities of images formed at different speeds may be reduced.

The absolute specific gravity of the resin-coated carrier included in the developer according to the exemplary embodiment is 3 g/cm$^3$ or more and 4 g/cm$^3$ or less. If the absolute specific gravity of the resin-coated carrier is more than 4 g/cm$^3$, an excessively high pressure may be applied to the toner particles when the toner particles are stirred in a developing apparatus and, consequently, an excessively large amount of non-ionic surfactant may migrate onto the surfaces of the toner particles and adhere onto the surfaces of the resin-coated carrier particles. It is considered that, in such a case, the state of the magnetic brush is not likely to become stable.

On the other hand, since the resin-coated carrier includes a magnetic material in order to achieve the electric properties appropriate for a carrier included in a developer, the absolute specific gravity of a resin-coated carrier is generally 3 g/cm$^3$ or more. The specific gravity of the resin-coated carrier is 3 g/cm$^3$ or more in order to apply an adequate pressure to the toner particles by stirring the toner particles in a developing apparatus.

For the above reasons, the absolute specific gravity of the resin-coated carrier is 3 g/cm$^3$ or more and 4 g/cm$^3$ or less, is preferably 3.1 g/cm$^3$ or more and 3.9 g/cm$^3$ or less, and is more preferably 3.2 g/cm$^3$ or more and 3.8 g/cm$^3$ or less.

The absolute specific gravity of the resin-coated carrier is determined by the pycnometer method described in JIS K0061:2001 "Test methods for density and relative density of chemical products".

The absolute specific gravity of the resin-coated carrier may be controlled by, for example, adding a resin to the magnetic particles and changing the amount of the resin; or changing the coverage of the resin layer.

The developer according to the exemplary embodiment may be prepared by mixing the toner and the resin-coated carrier at an adequate ratio. The mixing ratio between the toner and the resin-coated carrier (Toner:Resin-coated carrier) is preferably, by mass, 1:100 to 30:100 and is more preferably 3:100 to 20:100.

Details of the developer according to the exemplary embodiment are described below.

Toner Particles

The toner particles include at least a binder resin, a release agent, and a non-ionic surfactant. The toner particles may further include other resins, colorants, and other additives.

Non-Ionic Surfactant

Examples of the non-ionic surfactant included in the toner particles according to the exemplary embodiment include ethers, such as a polyoxyethylene alkyl ether, a polyoxyethylene alkyl allyl ether, a polyoxyethylene alkyl phenyl ether, and a polyoxyethylene polyoxypropylene glycol; esters formed by an ester linkage of an polyhydric alcohol, such as glycerin, sorbitol, or cane sugar, with a fatty acid; ester-ethers produced by addition reaction of ethylene oxide to an ester of a polyhydric alcohol, such as glycerin, sorbitol, or cane sugar, with a fatty acid; and fatty acid alkanolamides. Among these, a polyoxyethylene alkyl ether is preferable, and a polyoxyethylene lauryl ether is more preferable.

The amount of the non-ionic surfactant included in the developer according to the exemplary embodiment is preferably, by mass, 0.5 ppm or more and 10 ppm or less, is more preferably 1 ppm or more and 5 ppm or less, and is further preferably 2.5 ppm or more and 3.5 ppm or less of the amount of the resin-coated carrier included in the developer. When the amount of the non-ionic surfactant included in the developer falls within the above range, the difference between the densities of images formed at different speeds may be reduced with further efficiency.

The toner particles included in the developer according to the exemplary embodiment may include a polyoxyethylene lauryl ether as a non-ionic surfactant. In such a case, the amount of polyoxyethylene lauryl ether included in the developer is preferably, by mass, 0.5 ppm or more and 10 ppm or less, is more preferably 1 ppm or more and 5 ppm or less, and is further preferably 2.5 ppm or more and 3.5 ppm or less of the amount of the resin-coated carrier included in the developer.

The content of the non-ionic surfactant may be determined by the following method.

The toner and the carrier are separated from each other through a mesh net having an opening of 16 μm. Subsequently, the toner is washed with water. Then, the amount of the non-ionic surfactant is determined by liquid chromatography. Furthermore, the ratio (ppm) of the amount of the non-ionic surfactant to the amount of the resin-coated carrier constituting the developer is calculated.

The non-ionic surfactant may be added to the toner particles by using the non-ionic surfactant as a surfactant when the toner particles are formed by the wet process, such as aggregation coalescence, suspension polymerization, or dissolution suspension, which is described below.

Binder Resin

The toner particles according to the exemplary embodiment preferably include, as a binder resin, at least an amorphous resin and more preferably include an amorphous resin and a crystalline resin.

In the exemplary embodiment, the term "crystalline" resin refers to a resin that, in thermal analysis using differential scanning calorimetry (DSC), exhibits a distinct endothermic peak instead of step-like endothermic change and specifically refers to a resin that exhibits an endothermic peak with a half-width of 10° C. or less at a heating rate of 10° C./min. On the other hand, the term "amorphous" resin refers to a resin that exhibits an endothermic peak with a half-width of more than 10° C., that exhibits step-like endothermic change, or that does not exhibit a distinct endothermic peak.

Amorphous Resin

The amorphous resin may be, but is not limited to, at least one selected from an amorphous polyester resin and a modified amorphous polyester resin that is an amorphous polyester resin modified with at least one selected from a styrene and a (meth)acrylic acid ester.

Examples of the modified amorphous polyester resin that is an amorphous polyester resin modified with at least one selected from a styrene and a (meth)acrylic acid ester include a resin that includes a backbone constituted by an amorphous polyester resin and a side chain constituted by a styrene acrylate resin; a resin that includes a backbone constituted by a styrene acrylate resin and a side chain constituted by an amorphous polyester resin; a resin that includes a backbone constituted by an amorphous polyester resin and a styrene acrylate resin that are chemically bonded to each other; and a resin that includes a backbone constituted by an amorphous polyester resin and a styrene acrylate resin that are chemically bonded to each other and at least one selected from a side chain constituted by an amorphous polyester resin and a side chain constituted by a styrene acrylate resin.

Hereinafter, a modified amorphous polyester resin that is an amorphous polyester resin modified with at least one selected from a styrene and a (meth)acrylic acid ester is referred to as "hybrid amorphous resin"; the polyester-resin site included in the hybrid amorphous resin is referred to as "polyester segment"; and the polymer site of the hybrid amorphous resin which is constituted by at least one selected from a styrene and a (meth)acrylic acid ester is referred to as "styrene acrylate segment". In the hybrid amorphous resin, the polyester segment and the styrene acrylate segment are chemically bonded to each other.

Hybrid Amorphous Resin

The hybrid amorphous resin included in the toner particles according to the exemplary embodiment is not limited and may be any amorphous resin the molecule of which includes the polyester segment and the styrene acrylate segment.

Polyester Segment

The polyester segment of the hybrid amorphous resin is the site that includes a sequence of ester linkages (—COO—).

An example of the polyester segment of the hybrid amorphous resin according to the exemplary embodiment is a polymer produced by condensation between a polyhydric alcohol and a polyvalent carboxylic acid.

Examples of the polyhydric alcohol include aliphatic diols, such as ethylene glycol, 1,2-propanediol, 1,3-propanediol, 1,2-butanediol, 1,3-butanediol, 1,4-butanediol, 2,3-butanediol, neopentyl glycol, 1,4-butenediol, 1,5-pentanediol, 1,6-hexanediol, 1,8-octanediol, 1,9-nonanediol, 1,10-decanediol, and 1,12-dodecanediol; alicyclic diols, such as cyclohexanediol, cyclohexanedimethanol, and hydrogenated bisphenol A; and aromatic diols, such as bisphenol A, bisphenol A-ethylene oxide adduct, and bisphenol A-propylene oxide adduct.

Trihydric or higher alcohols having a crosslinked structure or a branched structure may be used as a polyhydric alcohol in combination with the diols. Examples of the trihydric or higher alcohols include glycerin, trimethylolpropane, pentaerythritol, and sorbitol.

The above polyhydric alcohols may be used alone or in combination of two or more.

The polyhydric alcohol is preferably an aromatic diol, is more preferably at least one selected from the group consisting of bisphenol A-ethylene oxide adduct and bisphenol A-propylene oxide adduct, and is further preferably bisphenol A-propylene oxide adduct. The average number of moles of adduct in the bisphenol A-ethylene oxide adduct or the bisphenol A-propylene oxide adduct is preferably 1 or more and 16 or less, is more preferably 1.2 or more and 12 or less, is further preferably 1.5 or more and 8 or less, and is particularly preferably 2 or more and 4 or less.

The ratio of the total amount of bisphenol A-ethylene oxide adduct and bisphenol A-propylene oxide adduct to the total amount of all the alcohol components that constitute the polyester segment of the hybrid amorphous resin is preferably 10 mol % or more and 90 mol % or less, is more preferably 20 mol % or more and 80 mol % or less, and is further preferably 30 mol % or more and 70 mol % or less.

Examples of the polyvalent carboxylic acid include aliphatic dicarboxylic acids, such as oxalic acid, malonic acid, maleic acid, fumaric acid, citraconic acid, itaconic acid, glutaconic acid, succinic acid, alkenylsuccinic acid (e.g., dodecenylsuccinic acid or octenylsuccinic acid), adipic acid, sebacic acid, 1,12-dodecanedioic acid, and azelaic acid; alicyclic dicarboxylic acids, such as cyclohexanedicarboxylic acid; aromatic dicarboxylic acids, such as terephthalic acid, isophthalic acid, phthalic acid, and naphthalenedicarboxylic acid; anhydrides of the above carboxylic acids; and lower alkyl esters of the above carboxylic acids which include 1 to 5 carbon atoms and preferably include 1 to 3 carbon atoms.

Trivalent or higher carboxylic acids having a crosslinked structure or a branched structure may be used as a polyvalent carboxylic acid in combination with the dicarboxylic acids. Examples of the trivalent or higher carboxylic acids include trimellitic acid, pyromellitic acid, anhydrides of these carboxylic acids, and lower alkyl esters of these carboxylic acids which include 1 to 5 carbon atoms and preferably include 1 to 3 carbon atoms.

The above polyvalent carboxylic acids may be used alone or in combination of two or more.

The carboxylic acid component of the polyester segment may include at least one non-aromatic dicarboxylic acid including an unsaturated carbon-carbon bond. This dicarboxylic acid forms a part of the polyester segment by condensation polymerization with the polyhydric alcohol, and the styrene acrylate segment chemically bonds to the polyester segment by addition polymerization of a styrene or a (meth)acrylic acid ester to the unsaturated carbon-carbon bond derived from the dicarboxylic acid.

Examples of the non-aromatic dicarboxylic acid that includes an unsaturated carbon-carbon bond include fumaric acid, maleic acid, 1,2,3,6-tetrahydrophthalic acid, alkenylsuccinic acid, such as dodecenylsuccinic acid or octenylsuccinic acid, and anhydrides of the above dicarboxylic acids. Among these, fumaric acid is preferable in terms of reactivity.

Styrene Acrylate Segment

An example of the styrene acrylate segment of the hybrid amorphous resin according to the exemplary embodiment is a segment produced by addition polymerization of an addition polymerizable monomer. Examples of the addition polymerizable monomer that constitutes the styrene acrylate segment include a styrene, a (meth)acrylic acid ester, and a monomer including an ethylenically unsaturated double bond, which are commonly used for synthesis of styrene acrylate resins.

Examples of the styrene that constitutes the styrene acrylate segment include substituted and unsubstituted styrenes. Examples of the substituent group included in the styrenes include an alkyl group having 1 to 5 carbon atoms, a halogen atom, an alkoxy group having 1 to 5 carbon atoms, a sulfo group, and salts of the above groups. Specific examples of the styrene include styrene, methylstyrene, α-methylstyrene, β-methylstyrene, t-butylstyrene, chlorostyrene, chloromethylstyrene, methoxystyrene, styrenesulfonic acid, and salts of the above styrenes. Among these, styrene is preferable.

Examples of the (meth)acrylic acid ester that constitutes the styrene acrylate segment include a (meth)acrylic acid alkyl ester (e.g., the alkyl group has 1 to 24 carbon atoms), benzyl (meth)acrylate, and dimethylaminoethyl (meth)acrylate. Among these, a (meth)acrylic acid alkyl ester in which the alkyl group has 1 to 18 carbon atoms is preferable, a (meth)acrylic acid alkyl ester in which the alkyl group has 1 to 12 carbon atoms is more preferable, and a (meth)acrylic acid alkyl ester in which the alkyl group has 1 to 8 carbon atoms is further preferable. Specific examples of the (meth) acrylic acid alkyl ester include methyl (meth)acrylate, ethyl (meth)acrylate, (iso)propyl (meth)acrylate, butyl (meth) acrylate, amyl (meth)acrylate, cyclohexyl (meth)acrylate, 2-ethylhexyl (meth)acrylate, octyl (meth)acrylate, decyl (meth)acrylate, dodecyl (meth)acrylate, palmityl (meth) acrylate, stearyl (meth)acrylate, and behenyl (meth)acrylate.

The monomer that constitutes the styrene acrylate segment may include at least one non-aromatic monocarboxylic acid including an unsaturated carbon-carbon bond. This monocarboxylic acid forms a part of the styrene acrylate segment by addition polymerization, and the styrene acrylate segment hybridizes with the polyester segment by condensation polymerization of the carboxyl group derived from the monocarboxylic acid and the alcohol component of the polyester segment. The non-aromatic monocarboxylic acid including an unsaturated carbon-carbon bond is preferably one or more monocarboxylic acids selected from an acrylic acid and a methacrylic acid and is more preferably an acrylic acid.

Examples of other monomers that constitute the styrene acrylate segment include olefins, such as ethylene, propylene, and butadiene; halovinyls, such as vinyl chloride; vinyl esters, such as vinyl acetate and vinyl propionate; vinyl ethers, such as vinyl methyl ether; halogenated vinylidenes, such as vinylidene chloride; and N-vinyl compounds, such as N-vinyl pyrrolidone.

The ratio of the total amount of the styrenes to the total amount of all the monomers that constitute the styrene acrylate segment of the hybrid amorphous resin is preferably 20% by mass or more and 80% by mass or less, is more preferably 30% by mass or more and 70% by mass or less, and is further preferably 40% by mass or more and 60% by mass or less.

The ratio of the total amount of the (meth)acrylic acid esters to the total amount of all the monomers that constitute the styrene acrylate segment of the hybrid amorphous resin is preferably 20% by mass or more and 80% by mass or less, is more preferably 30% by mass or more and 70% by mass or less, and is further preferably 40% by mass or more and 60% by mass or less.

The ratio of the total amount of the styrenes and the (meth)acrylic acid esters to the total amount of all the monomers that constitute the styrene acrylate segment of the hybrid amorphous resin is preferably 80% by mass or more, is more preferably 90% by mass or more, is further preferably 95% by mass or more, and is particularly preferably 100% by mass.

The ratio of the total amount of the polyester segment and the styrene acrylate segment to the amount of the entire hybrid amorphous resin is preferably 80% by mass or more, is more preferably 90% by mass or more, is further preferably 95% by mass or more, and is particularly preferably 100% by mass.

In the hybrid amorphous resin, the ratio of the amount of the styrene acrylate segment to the total amount of the polyester segment and the styrene acrylate segment is preferably 1% by mass or more and 50% by mass or less, is more preferably 5% by mass or more and 40% by mass or less, and is further preferably 10% by mass or more and 30% by mass or less.

The weight-average molecular weight (Mw) of the hybrid amorphous resin is preferably 5,000 or more and 500,000 or less, is more preferably 10,000 or more and 100,000 or less, and is further preferably 15,000 or more and 50,000 or less.

In the present disclosure, the weight-average molecular weight and number-average molecular weight of a resin are determined by gel permeation chromatography (GPC). Specifically, the above molecular weights of a resin are determined by GPC using a "HLC-8120GPC" produced by Tosoh Corporation as measuring equipment, a column "TSKgel SuperHM-M (15 cm)" produced by Tosoh Corporation, and a tetrahydrofuran (THF) solvent. The weight-average molecular weight and number-average molecular weight of the resin are determined on the basis of a molecular-weight calibration curve prepared using the results of the measurement and monodisperse polystyrene standard samples.

The glass transition temperature (Tg) of the hybrid amorphous resin is preferably 25° C. or more and 80° C. or less, is more preferably 30° C. or more and 70° C. or less, and is further preferably 40° C. or more and 60° C. or less.

In the present disclosure, the glass transition temperature of a resin is determined on the basis of a curve obtained by differential scanning calorimetry (DSC), that is, a DSC curve. More specifically, the glass transition temperature of a resin is determined on the basis of the "extrapolated glass-transition-starting temperature" according to a method for determining glass transition temperature which is described in JIS K 7121:1987 "Testing Methods for Transition Temperatures of Plastics".

The acid value of the hybrid amorphous resin is preferably 5 mgKOH/g or more and 40 mgKOH/g or less, is more preferably 10 mgKOH/g or more and 35 mgKOH/g or less, and is further preferably 15 mgKOH/g or more and 30 mgKOH/g or less.

The hybrid amorphous resin may be produced by any of the methods (i) to (iii) below.

(i) The polyester segment is prepared by condensation polymerization of the polyhydric alcohol and the polyvalent carboxylic acid, and addition polymerization of monomers that constitute the styrene acrylate segment to the polyester segment is performed.

(ii) The styrene acrylate segment is prepared by addition polymerization of the addition polymerizable monomer, and condensation polymerization of the polyhydric alcohol and the polyvalent carboxylic acid is performed.

(iii) Condensation polymerization of the polyhydric alcohol and the polyvalent carboxylic acid and addition polymerization of the addition polymerizable monomers are performed simultaneously.

Amorphous Polyester Resin

Examples of the amorphous polyester resin include condensation polymers of a polyvalent carboxylic acid and a polyhydric alcohol. The amorphous polyester resin may be a commercially available one or a synthesized one.

Examples of the polyvalent carboxylic acid include aliphatic dicarboxylic acids, such as oxalic acid, malonic acid, maleic acid, fumaric acid, citraconic acid, itaconic acid, glutaconic acid, succinic acid, alkenyl succinic acid, adipic acid, and sebacic acid; alicyclic dicarboxylic acids, such as cyclohexanedicarboxylic acid; aromatic dicarboxylic acids, such as terephthalic acid, isophthalic acid, phthalic acid, and naphthalenedicarboxylic acid; anhydrides of these dicarboxylic acids; and lower (e.g., 1 to 5 carbon atoms) alkyl esters of these dicarboxylic acids. Among these dicarboxylic acids, for example, aromatic dicarboxylic acids may be used as a polyvalent carboxylic acid.

Trivalent or higher carboxylic acids having a crosslinked structure or a branched structure may be used as a polyvalent carboxylic acid in combination with the dicarboxylic acids. Examples of the trivalent or higher carboxylic acids include trimellitic acid, pyromellitic acid, anhydrides of these carboxylic acids, and lower (e.g., 1 to 5 carbon atoms) alkyl esters of these carboxylic acids.

The above polyvalent carboxylic acids may be used alone or in combination of two or more.

Examples of the polyhydric alcohol include aliphatic diols, such as ethylene glycol, diethylene glycol, triethylene glycol, propylene glycol, butanediol, hexanediol, and neopentyl glycol; alicyclic diols, such as cyclohexanediol, cyclohexanedimethanol, and hydrogenated bisphenol A; and aromatic diols, such as bisphenol A-ethylene oxide adduct and bisphenol A-propylene oxide adduct. Among these diols, for example, aromatic diols and alicyclic diols may be used as a polyhydric alcohol. In particular, aromatic diols may be used as a polyhydric alcohol.

Trihydric or higher alcohols having a crosslinked structure or a branched structure may be used as a polyhydric alcohol in combination with the diols. Examples of the trihydric or higher alcohols include glycerin, trimethylolpropane, and pentaerythritol.

The above polyhydric alcohols may be used alone or in combination of two or more.

The glass transition temperature Tg of the amorphous polyester resin is preferably 50° C. or more and 80° C. or less and is more preferably 50° C. or more and 65° C. or less.

The weight-average molecular weight Mw of the amorphous polyester resin is preferably 5,000 or more and 1,000,000 or less and is more preferably 7,000 or more and 500,000 or less. The number-average molecular weight Mn of the amorphous polyester resin is preferably 2,000 or more and 100,000 or less. The molecular weight distribution index Mw/Mn of the amorphous polyester resin is preferably 1.5 or more and 100 or less and is more preferably 2 or more and 60 or less.

The amorphous polyester resin may be produced by any suitable production method known in the related art. Specifically, the amorphous polyester resin may be produced by, for example, a method in which polymerization is performed at 180° C. or more and 230° C. or less and the pressure inside the reaction system is reduced as needed while water and alcohols that are generated by condensation are removed.

In the case where the raw materials, that is, the monomers, are not dissolved in or compatible with each other at the reaction temperature, a solvent having a high boiling point may be used as a dissolution adjuvant in order to dissolve the raw materials. In such a case, the condensation polymerization reaction is performed while the dissolution adjuvant is distilled away. In the case where monomers used for copolymerization have low compatibility with each other, a condensation reaction of the monomers with an acid or alcohol that is to undergo a polycondensation reaction with the monomers may be performed in advance and subsequently polycondensation of the resulting polymers with the other components may be performed.

In the exemplary embodiment, the ratio of the total amount of the amorphous polyester resin and the hybrid amorphous resin to the total amount of the amorphous resins included in the toner particles as binder resins is preferably 80% by mass or more and 100% by mass or less, is more preferably 90% by mass or more and 100% by mass or less, is further preferably 95% by mass or more and 100% by mass or less, and is particularly preferably 100% by mass.

Crystalline Resin

In the exemplary embodiment, the toner particles may include a crystalline resin. The crystalline resin may be, but is not limited to, at least one selected from a crystalline polyester resin and a modified crystalline polyester resin that is a crystalline polyester resin modified with at least one selected from a styrene and a (meth)acrylic acid ester.

Examples of the modified crystalline polyester resin that is a crystalline polyester resin modified with at least one selected from a styrene and a (meth)acrylic acid ester include a resin that includes a backbone constituted by a crystalline polyester resin and a side chain constituted by a styrene acrylate resin; a resin that includes a backbone constituted by a styrene acrylate resin and a side chain constituted by a crystalline polyester resin; a resin that includes a backbone constituted by a crystalline polyester resin and a styrene acrylate resin that are chemically bonded to each other; and a resin that includes a backbone constituted by a crystalline polyester resin and a styrene acrylate resin that are chemically bonded to each other and at least one selected from a side chain constituted by a crystalline polyester resin and a side chain constituted by a styrene acrylate resin.

Hereinafter, a modified crystalline polyester resin that is a crystalline polyester resin modified with at least one selected from a styrene and a (meth)acrylic acid ester is referred to as "hybrid crystalline resin"; the polyester-resin site included in the hybrid crystalline resin is referred to as "polyester segment"; and the polymer site of the hybrid crystalline resin which is constituted by at least one selected from a styrene and a (meth)acrylic acid ester is referred to as "styrene acrylate segment". In the hybrid crystalline resin, the polyester segment and the styrene acrylate segment are chemically bonded to each other.

Hybrid Crystalline Resin

The hybrid crystalline resin included in the toner particles according to the exemplary embodiment is not limited and may be any crystalline resin the molecule of which includes the polyester segment and the styrene acrylate segment.

Polyester Segment

The polyester segment of the hybrid crystalline resin is the site that includes a sequence of ester linkages (—COO—).

An example of the polyester segment of the hybrid crystalline resin according to the exemplary embodiment is a polymer produced by condensation between a polyhydric alcohol and a polyvalent carboxylic acid. In order to increase ease of formation of a crystal structure, a condensation polymer prepared from linear aliphatic polymerizable monomers may be used as a polyester segment instead of a condensation polymer prepared from polymerizable monomers including an aromatic ring.

Examples of the polyhydric alcohol include aliphatic diols, such as linear aliphatic diols including a backbone having 7 to 20 carbon atoms. Examples of the aliphatic diols include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,14-eicosanedecanediol. Among these aliphatic diols, 1,8-octanediol, 1,9-nonanediol, and 1,10-decanediol may be used.

Trihydric or higher alcohols having a crosslinked structure or a branched structure may be used as a polyhydric alcohol in combination with the above diols. Examples of the trihydric or higher alcohols include glycerin, trimethylolethane, trimethylolpropane, and pentaerythritol.

The above polyhydric alcohols may be used alone or in combination of two or more.

Examples of the polyvalent carboxylic acid include aliphatic dicarboxylic acids, such as oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, and 1,18-octadecanedicarboxylic acid; aromatic dicarboxylic acids, such as dibasic acids (e.g., phthalic acid, isophthalic acid, terephthalic acid, and naphthalene-2,6-dicarboxylic acid); anhydrides of these dicarboxylic acids; and lower (e.g., 1 to 5 carbon atoms) alkyl esters of these dicarboxylic acids.

Trivalent or higher carboxylic acids having a crosslinked structure or a branched structure may be used as a polyvalent carboxylic acid in combination with the dicarboxylic acids. Examples of the trivalent carboxylic acids include aromatic carboxylic acids, such as 1,2,3-benzenetricarboxylic acid, 1,2,4-benzenetricarboxylic acid, and 1,2,4-naphthalenetricarboxylic acid; anhydrides of these tricarboxylic acids; and lower (e.g., 1 to 5 carbon atoms) alkyl esters of these tricarboxylic acids.

Dicarboxylic acids including a sulfonic group and dicarboxylic acids including an ethylenic double bond may be used as a polyvalent carboxylic acid in combination with the above dicarboxylic acids.

The above polyvalent carboxylic acids may be used alone or in combination of two or more.

The carboxylic acid component of the polyester segment may include at least one non-aromatic dicarboxylic acid including an unsaturated carbon-carbon bond. This dicarboxylic acid forms a part of the polyester segment by condensation polymerization with the polyhydric alcohol, and the styrene acrylate segment chemically bonds to the polyester segment by addition polymerization of a styrene or a (meth)acrylic acid ester to the unsaturated carbon-carbon bond derived from the dicarboxylic acid.

Examples of the non-aromatic dicarboxylic acid that includes an unsaturated carbon-carbon bond include fumaric acid, maleic acid, 1,2,3,6-tetrahydrophthalic acid, alkenylsuccinic acid, such as dodecenylsuccinic acid or octenylsuccinic acid, and anhydrides of the above dicarboxylic acids. Among these, fumaric acid is preferable in terms of reactivity.

Styrene Acrylate Segment

An example of the styrene acrylate segment of the hybrid crystalline resin according to the exemplary embodiment is a segment produced by addition polymerization of an addition polymerizable monomer. Examples of the addition polymerizable monomer that constitutes the styrene acrylate segment include a styrene, a (meth)acrylic acid ester, and a monomer including an ethylenically unsaturated double bond, which are commonly used for synthesis of styrene acrylate resins.

Examples of the styrene that constitutes the styrene acrylate segment include substituted and unsubstituted styrenes. Examples of the substituent group included in the styrenes include an alkyl group having 1 to 5 carbon atoms, a halogen atom, an alkoxy group having 1 to 5 carbon atoms, a sulfo group, and salts of the above groups. Specific examples of the styrene include styrene, methylstyrene, α-methylstyrene, β-methylstyrene, t-butylstyrene, chlorostyrene, chloromethylstyrene, methoxystyrene, styrenesulfonic acid, and salts of the above styrenes. Among these, styrene is preferable.

Examples of the (meth)acrylic acid ester that constitutes the styrene acrylate segment include a (meth)acrylic acid alkyl ester (e.g., the alkyl group has 1 to 24 carbon atoms), benzyl (meth)acrylate, and dimethylaminoethyl (meth)acrylate. Among these, a (meth)acrylic acid alkyl ester in which the alkyl group has 1 to 18 carbon atoms is preferable, a (meth)acrylic acid alkyl ester in which the alkyl group has 1 to 12 carbon atoms is more preferable, and a (meth)acrylic acid alkyl ester in which the alkyl group has 1 to 8 carbon atoms is further preferable. Specific examples of the (meth) acrylic acid alkyl ester include methyl (meth)acrylate, ethyl (meth)acrylate, (iso)propyl (meth)acrylate, butyl (meth) acrylate, amyl (meth)acrylate, cyclohexyl (meth)acrylate, 2-ethylhexyl (meth)acrylate, octyl (meth)acrylate, decyl (meth)acrylate, dodecyl (meth)acrylate, palmityl (meth) acrylate, stearyl (meth)acrylate, and behenyl (meth)acrylate.

The monomer that constitutes the styrene acrylate segment may include at least one non-aromatic monocarboxylic acid including an unsaturated carbon-carbon bond. This monocarboxylic acid forms a part of the styrene acrylate segment by addition polymerization, and the styrene acrylate segment hybridizes with the polyester segment by condensation polymerization of the carboxyl group derived from the monocarboxylic acid and the alcohol component of the polyester segment. The non-aromatic monocarboxylic acid including an unsaturated carbon-carbon bond is preferably one or more monocarboxylic acids selected from an acrylic acid and a methacrylic acid and is more preferably an acrylic acid.

Examples of other monomers that constitute the styrene acrylate segment include olefins, such as ethylene, propylene, and butadiene; halovinyls, such as vinyl chloride; vinyl esters, such as vinyl acetate and vinyl propionate; vinyl ethers, such as vinyl methyl ether; halogenated vinylidenes, such as vinylidene chloride; and N-vinyl compounds, such as N-vinyl pyrrolidone.

The ratio of the total amount of the styrenes to the total amount of all the monomers that constitute the styrene acrylate segment of the hybrid crystalline resin is preferably 20% by mass or more and 80% by mass or less, is more preferably 30% by mass or more and 70% by mass or less, and is further preferably 40% by mass or more and 60% by mass or less.

The ratio of the total amount of the (meth)acrylic acid esters to the total amount of all the monomers that constitute the styrene acrylate segment of the hybrid crystalline resin is preferably 20% by mass or more and 80% by mass or less, is more preferably 30% by mass or more and 70% by mass or less, and is further preferably 40% by mass or more and 60% by mass or less.

The ratio of the total amount of the styrenes and the (meth)acrylic acid esters to the total amount of all the monomers that constitute the styrene acrylate segment of the hybrid crystalline resin is preferably 80% by mass or more, is more preferably 90% by mass or more, is further preferably 95% by mass or more, and is particularly preferably 100% by mass.

The ratio of the total amount of the polyester segment and the styrene acrylate segment to the amount of the entire hybrid crystalline resin is preferably 80% by mass or more, is more preferably 90% by mass or more, is further preferably 95% by mass or more, and is particularly preferably 100% by mass.

In the hybrid crystalline resin, the ratio of the amount of the styrene acrylate segment to the total amount of the polyester segment and the styrene acrylate segment is preferably 1% by mass or more and 50% by mass or less, is more preferably 5% by mass or more and 40% by mass or less, and is further preferably 10% by mass or more and 30% by mass or less.

The melting temperature of the hybrid crystalline resin is preferably 50° C. or more and 100° C. or less, is more preferably 55° C. or more and 90° C. or less, and is further preferably 60° C. or more and 85° C. or less.

In the present disclosure, the melting temperature of a resin is determined from the "melting peak temperature" according to a method for determining melting temperature which is described in JIS K 7121:1987 "Testing Methods for Transition Temperatures of Plastics" using a DSC curve obtained by differential scanning calorimetry (DSC).

The weight-average molecular weight Mw of the hybrid crystalline resin may be 6,000 or more and 35,000 or less.

The hybrid crystalline resin may be produced by any of the methods (i) to (iii) below.

(i) The polyester segment is prepared by condensation polymerization of the polyhydric alcohol and the polyvalent carboxylic acid, and addition polymerization of monomers that constitute the styrene acrylate segment to the polyester segment is performed.

(ii) The styrene acrylate segment is prepared by addition polymerization of the addition polymerizable monomer, and condensation polymerization of the polyhydric alcohol and the polyvalent carboxylic acid is performed.

(iii) Condensation polymerization of the polyhydric alcohol and the polyvalent carboxylic acid and addition polymerization of the addition polymerizable monomers are performed simultaneously.

Crystalline Polyester Resin

Examples of the crystalline polyester resin include condensation polymers of a polyvalent carboxylic acid and a polyhydric alcohol. The crystalline polyester resin may be commercially available one or a synthesized one.

In order to increase ease of formation of a crystal structure, a condensation polymer prepared from linear aliphatic polymerizable monomers may be used as a crystalline polyester resin instead of a condensation polymer prepared from polymerizable monomers including an aromatic ring.

Examples of the polyvalent carboxylic acid include aliphatic dicarboxylic acids, such as oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, and 1,18-octadecanedicarboxylic acid; aromatic dicarboxylic acids, such as dibasic acids (e.g., phthalic acid, isophthalic acid, terephthalic acid, and naphthalene-2,6-dicarboxylic acid); anhydrides of these dicarboxylic acids; and lower (e.g., 1 to 5 carbon atoms) alkyl esters of these dicarboxylic acids.

Trivalent or higher carboxylic acids having a crosslinked structure or a branched structure may be used as a polyvalent carboxylic acid in combination with the dicarboxylic acids. Examples of the trivalent carboxylic acids include aromatic carboxylic acids, such as 1,2,3-benzenetricarboxylic acid, 1,2,4-benzenetricarboxylic acid, and 1,2,4-naphthalenetricarboxylic acid; anhydrides of these tricarboxylic acids; and lower (e.g., 1 to 5 carbon atoms) alkyl esters of these tricarboxylic acids.

Dicarboxylic acids including a sulfonic group and dicarboxylic acids including an ethylenic double bond may be used as a polyvalent carboxylic acid in combination with the above dicarboxylic acids.

The above polyvalent carboxylic acids may be used alone or in combination of two or more.

Examples of the polyhydric alcohol include aliphatic diols, such as linear aliphatic diols including a backbone having 7 to 20 carbon atoms. Examples of the aliphatic diols include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,14-eicosanedecanediol. Among these aliphatic diols, 1,8-octanediol, 1,9-nonanediol, and 1,10-decanediol may be used.

Trihydric or higher alcohols having a crosslinked structure or a branched structure may be used as a polyhydric alcohol in combination with the above diols. Examples of the trihydric or higher alcohols include glycerin, trimethylolethane, trimethylolpropane, and pentaerythritol.

The above polyhydric alcohols may be used alone or in combination of two or more.

The content of the aliphatic diols in the polyhydric alcohol may be 80 mol % or more and is preferably 90 mol % or more.

The melting temperature of the crystalline polyester resin is preferably 50° C. or more and 100° C. or less, is more preferably 55° C. or more and 90° C. or less, and is further preferably 60° C. or more and 85° C. or less.

The crystalline polyester resin may have a weight-average molecular weight Mw of 6,000 or more and 35,000 or less.

In the case where the toner particles according to the exemplary embodiment include the crystalline resin, the amount of the crystalline resin is preferably 5% by mass or more and 40% by mass or less, is more preferably 8% by mass or more and 30% by mass or less, and is further preferably 10% by mass or more and 20% by mass or less of the total amount of the binder resins used.

In the exemplary embodiment, the ratio of the total amount of the crystalline polyester resin and the hybrid crystalline resin to the total amount of the crystalline resins included in the toner particles as binder resins is preferably 80% by mass or more and 100% by mass or less, is more preferably 90% by mass or more and 100% by mass or less, is further preferably 95% by mass or more and 100% by mass or less, and is particularly preferably 100% by mass.

The content of the binder resin in the toner particles is preferably 40% by mass or more and 95% by mass or less, is more preferably 50% by mass or more and 90% by mass or less, and is further preferably 60% by mass or more and 85% by mass or less.

Release Agent

Examples of the release agent include, but are not limited to, hydrocarbon waxes; natural waxes, such as a carnauba wax, a rice bran wax, and a candelilla wax; synthetic or mineral-petroleum-derived waxes, such as a montan wax; and ester waxes, such as a fatty-acid ester wax and a montanate wax.

The melting temperature of the release agent is preferably 50° C. or more and 110° C. or less and is more preferably 60° C. or more and 100° C. or less. The melting temperature of the release agent is determined from the "melting peak temperature" according to a method for determining melting temperature which is described in JIS K 7121:1987 "Testing Methods for Transition Temperatures of Plastics" using a DSC curve obtained by differential scanning calorimetry (DSC).

The content of the release agent in the toner particles is preferably 1% by mass or more and 20% by mass or less and is more preferably 5% by mass or more and 15% by mass or less.

An example of the release agent is a paraffin wax. The melting temperature of the paraffin wax is preferably 60° C. or more and 120° C. or less and is more preferably 85° C. or more and 105° C. or less.

An example of the release agent is a polyethylene wax. The melting temperature of the polyethylene wax is preferably 60° C. or more and 120° C. or less and is more preferably 85° C. or more and 105° C. or less.

An example of the release agent is an ester wax. The melting temperature of the ester wax is preferably 60° C. or more and 120° C. or less and is more preferably 85° C. or more and 105° C. or less.

Colorant

Examples of the colorant include pigments such as Carbon Black, Chrome Yellow, Hansa Yellow, Benzidine Yellow, Threne Yellow, Quinoline Yellow, Pigment Yellow, Permanent Orange GTR, Pyrazolone Orange, Vulcan Orange, Watching Red, Permanent Red, Brilliant Carmine 3B, Brilliant Carmine 6B, DuPont Oil Red, Pyrazolone Red, Lithol Red, Rhodamine B Lake, Lake Red C, Pigment Red, Rose Bengal, Aniline Blue, Ultramarine Blue, Calco Oil Blue, Methylene Blue Chloride, Phthalocyanine Blue, Pigment Blue, Phthalocyanine Green, and Malachite Green Oxalate; and dyes such as acridine dyes, xanthene dyes, azo dyes, benzoquinone dyes, azine dyes, anthraquinone dyes, thioindigo dyes, dioxazine dyes, thiazine dyes, azomethine dyes, indigo dyes, phthalocyanine dyes, aniline black dyes, polymethine dyes, triphenylmethane dyes, diphenylmethane dyes, and thiazole dyes.

The above colorants may be used alone or in combination of two or more.

The colorant may optionally be subjected to a surface treatment and may be used in combination with a dispersant. Plural types of colorants may be used in combination.

The content of the colorant in the toner particles is preferably 1% by mass or more and 30% by mass or less and is more preferably 3% by mass or more and 15% by mass or less.

Other Additives

Examples of the other additives include additives known in the related art, such as a magnetic substance, a charge-controlling agent, and an inorganic powder. These additives may be added to the toner particles as internal additives.

Properties, etc. of Toner Particles

The toner particles may have a single-layer structure or a "core-shell" structure constituted by a core (i.e., core particle) and a coating layer (i.e., shell layer) covering the core. The core-shell structure of the toner particles may be constituted by, for example, a core including a binder resin and, as needed, other additives such as a colorant and a release agent and by a coating layer including the binder resin.

The volume-average diameter D50v of the toner particles is preferably 2 μm or more and 10 μm or less and is more preferably 4 μm or more and 8 μm or less.

The above-described average diameters and particle diameter distribution indices of the toner particles are measured using "COULTER Multisizer II" (produced by Beckman Coulter, Inc.) with an electrolyte "ISOTON-II" (produced by Beckman Coulter, Inc.) in the following manner.

A sample to be measured (0.5 mg or more and 50 mg or less) is added to 2 ml of a 5 mass %-aqueous solution of a surfactant (e.g., sodium alkylbenzene sulfonate) that serves as a dispersant. The resulting mixture is added to 100 ml or more and 150 ml or less of an electrolyte.

The resulting electrolyte containing the sample suspended therein is subjected to a dispersion treatment for 1 minute using an ultrasonic disperser, and the distribution of the diameters of particles having a diameter of 2 μm or more and 60 μm or less is measured using COULTER Multisizer II with an aperture having a diameter of 100 μm. The number of the particles sampled is 50,000.

The particle diameter distribution measured is divided into a number of particle diameter ranges (i.e., channels). For each range, in ascending order in terms of particle diameter, the cumulative volume and the cumulative number are calculated and plotted to draw cumulative distribution curves. Particle diameters at which the cumulative volume and the cumulative number reach 16% are considered to be the volume particle diameter D16v and the number particle diameter D16p, respectively. Particle diameters at which the cumulative volume and the cumulative number reach 50% are considered to be the volume-average particle diameter D50v and the number-average particle diameter D50p, respectively. Particle diameters at which the cumulative volume and the cumulative number reach 84% are considered to be the volume particle diameter D84v and the number particle diameter D84p, respectively.

Using the volume particle diameters and number particle diameters measured, the volume particle diameter distribution index (GSDv) is calculated as $(D84v/D16v)^{1/2}$ and the number particle diameter distribution index (GSDp) is calculated as $(D84p/D16p)^{1/2}$.

The toner particles preferably has an average circularity of 0.94 or more and 1.00 or less. The average circularity of the toner particles is more preferably 0.95 or more and 0.98 or less.

The average circularity of the toner particles is determined as [Equivalent circle perimeter]/[Perimeter] (i.e., [Perimeter of a circle having the same projection area as the particles]/[Perimeter of the projection image of the particles]. Specifically, the average circularity of the toner particles is determined by the following method.

The toner particles to be measured are sampled by suction so as to form a flat stream. A static image of the particles is taken by instantaneously flashing a strobe light. The image of the particles is analyzed with a flow particle image analyzer "FPIA-3000" produced by Sysmex Corporation. The number of samples used for determining the average circularity of the toner particles is 3500.

In the case where the toner includes an external additive, the toner (i.e., the developer) to be measured is dispersed in water containing a surfactant and then subjected to an ultrasonic wave treatment in order to remove the external additive from the toner particles.

External Additive

Examples of the external additive include inorganic particles. Examples of the inorganic particles include $SiO_2$ particles, $TiO_2$ particles, $Al_2O_3$ particles, CuO particles, ZnO particles, $SnO_2$ particles, $CeO_2$ particles, $Fe_2O_3$ particles, MgO particles, BaO particles, CaO particles, $K_2O$ particles, $Na_2O$ particles, $ZrO_2$ particles, $CaO.SiO_2$ particles, $K_2O.(TiO_2)_n$ particles, $Al_2O_3.2SiO_2$ particles, $CaCO_3$ particles, $MgCO_3$ particles, $BaSO_4$ particles, and $MgSO_4$ particles.

The surfaces of the inorganic particles used as the external additive may be subjected to a hydrophobic treatment. The hydrophobic treatment may be performed by, for example, immersing the inorganic particles in a hydrophobizing agent. Examples of the hydrophobizing agent include, but are not limited to, a silane coupling agent, silicone oil, a titanate coupling agent, and aluminium coupling agent. These hydrophobizing agents may be used alone or in combination of two or more. The amount of the hydrophobizing agent used is normally, for example, 1 part by mass or more and 10 parts by mass or less relative to 100 parts by mass of the inorganic particles used.

Examples of other external additives include particles of a resin, such as polystyrene, polymethyl methacrylate, or a melamine resin; and particles of a cleaning lubricant, such as a metal salt of a higher fatty acid (e.g., zinc stearate) or a fluorine-based high-molecular-weight compound.

The amount of the external additive deposited on the toner particles is preferably 0.01% by mass or more and 5% by mass or less and is more preferably 0.01% by mass or more and 2.0% by mass or less of the amount of the toner particles.

Method for Producing Toner

The toner according to the exemplary embodiment is produced by, after the preparation of the toner particles, depositing an external additive on the surfaces of the toner particles.

The toner particles may be prepared by any dry process, such as knead pulverization, or any wet process, such as aggregation coalescence, suspension polymerization, or dissolution suspension. However, a method for preparing the toner particles is not limited thereto, and any suitable method known in the related art may be used. Among these methods, aggregation coalescence may be used in order to prepare the toner particles.

Specifically, in the case where, for example, aggregation coalescence is used in order to prepare the toner particles, the toner particles are prepared by the following steps:

preparing a resin particle dispersion liquid in which resin particles serving as a binder resin are dispersed (i.e., resin particle dispersion liquid preparation step);

causing the resin particles (and, as needed, other particles) to aggregate together in the resin particle dispersion liquid (or in the resin particle dispersion liquid mixed with another particle dispersion liquid as needed) in order to form aggregated particles (i.e., aggregated particle formation step);

and heating the resulting aggregated particle dispersion liquid in which the aggregated particles are dispersed in order to cause fusion and coalescence of the aggregated particles to occur and thereby form toner particles (fusion-coalescence step).

Each of the above steps is described below in detail. Hereinafter, a method for preparing toner particles including a colorant and a release agent is described. However, it should be noted that the colorant and the release agent are optional. It is needless to say that additives other than a colorant and a release agent may be used.

Resin Particle Dispersion Liquid Preparation Step

In addition to a resin particle dispersion liquid in which resin particles serving as a binder resin is dispersed, for example, a colorant particle dispersion liquid in which colorant particles are dispersed and a release-agent particle dispersion liquid in which release-agent particles are dispersed are prepared.

The resin particle dispersion liquid is prepared by, for example, dispersing resin particles in a dispersion medium using a surfactant.

Examples of the dispersion medium used for preparing the resin particle dispersion liquid include aqueous media. Examples of the aqueous media include water, such as distilled water and ion-exchange water; and alcohols. These aqueous media may be used alone or in combination of two or more.

Examples of the surfactant include anionic surfactants, such as sulfate-based surfactants, sulfonate-based surfactants, and phosphate-based surfactants; cationic surfactants, such as amine-salt-based surfactants and quaternary-ammonium-salt-based surfactants; and non-ionic surfactants, such as polyethylene-glycol surfactants, alkylphenol-ethylene-oxide-adduct-based surfactants, and polyhydric-alcohol-based surfactants. Among these surfactants, in particular, the anionic surfactants and the cationic surfactants may be used. The non-ionic surfactants may be used in combination with the anionic surfactants and the cationic surfactants. These surfactants may be used alone or in combination of two or more.

In the preparation of the resin particle dispersion liquid, the resin particles can be dispersed in a dispersion medium by any suitable dispersion method commonly used in the related art in which, for example, a rotary-shearing homogenizer, a ball mill, a sand mill, or a dyno mill that includes media is used. Depending on the type of the resin particles used, the resin particles may be dispersed in the dispersion medium by, for example, phase-inversion emulsification. Phase-inversion emulsification is a method in which the resin to be dispersed is dissolved in a hydrophobic organic solvent in which the resin is soluble, a base is added to the resulting organic continuous phase (i.e., 0 phase) to perform neutralization, and subsequently an aqueous medium (i.e., W phase) is charged in order to perform phase inversion from W/O to O/W and disperse the resin in the aqueous medium in the form of particles.

The volume-average diameter of the resin particles dispersed in the resin particle dispersion liquid is preferably, for example, 0.01 μm or more and 1 μm or less, is more preferably 0.08 μm or more and 0.8 μm or less, and is further preferably 0.1 μm or more and 0.6 μm or less.

The volume-average diameter of the resin particles is determined in the following manner. The particle diameter distribution of the resin particles is obtained using a laser-diffraction-type particle-size-distribution measurement apparatus (e.g., "LA-700" produced by HORIBA, Ltd.). The particle diameter distribution measured is divided into a number of particle diameter ranges (i.e., channels). For each range, in ascending order in terms of particle diameter, the cumulative volume is calculated and plotted to draw a cumulative distribution curve. A particle diameter at which the cumulative volume reaches 50% is considered to be the volume particle diameter D50v. The volume-average diameters of particles included in the other dispersion liquids are also determined in the above-described manner.

The content of the resin particles included in the resin particle dispersion liquid is preferably 5% by mass or more and 50% by mass or less and is more preferably 10% by mass or more and 40% by mass or less.

The colorant particle dispersion liquid, the release-agent particle dispersion liquid, and the like are also prepared as in the preparation of the resin particle dispersion liquid. In other words, the above-described specifications for the volume-average diameter of the particles included in the resin particle dispersion liquid, the dispersion medium of the resin particle dispersion liquid, the dispersion method used for preparing the resin particle dispersion liquid, and the content of the particles in the resin particle dispersion liquid can also be applied to colorant particles dispersed in the colorant particle dispersion liquid and release-agent particles dispersed in the release-agent particle dispersion liquid.

Aggregated Particle Formation Step

The resin particle dispersion liquid is mixed with the colorant particle dispersion liquid and the release-agent particle dispersion liquid.

In the resulting mixed dispersion liquid, heteroaggregation of the resin particles with the colorant particles and the release-agent particles is performed in order to form aggregated particles including the resin particles, the colorant particles, and the release-agent particles, the aggregated particles having a diameter close to that of the desired toner particles.

Specifically, for example, a flocculant is added to the mixed dispersion liquid, and the pH of the mixed dispersion liquid is controlled to be acidic (e.g., pH of 2 or more and 5 or less). A dispersion stabilizer may be added to the mixed dispersion liquid as needed. Subsequently, the mixed dispersion liquid is heated to a temperature close to the glass transition temperature of the resin particles (specifically, e.g., [glass transition temperature of the resin particles−30° C.] or more and [the glass transition temperature−10° C.] or less), and thereby the particles dispersed in the mixed dispersion liquid are caused to aggregate together to form aggregated particles.

In the aggregated particle formation step, alternatively, for example, the above flocculant may be added to the mixed dispersion liquid at room temperature (e.g., 25° C.) while the mixed dispersion liquid is stirred using a rotary-shearing homogenizer. Then, the pH of the mixed dispersion liquid is controlled to be acidic (e.g., pH of 2 or more and 5 or less), and a dispersion stabilizer may be added to the mixed dispersion liquid as needed. Subsequently, the mixed dispersion liquid is heated in the above-described manner.

Examples of the flocculant include surfactants, inorganic metal salts, and divalent or higher metal complexes that have a polarity opposite to that of the surfactant included in the mixed dispersion liquid. Using a metal complex as a flocculant reduces the amount of surfactant used and, as a result, charging characteristics may be enhanced.

An additive capable of forming a complex or a bond similar to a complex with the metal ions contained in the flocculant may optionally be used in combination with the flocculant. An example of the additive is a chelating agent.

Examples of the inorganic metal salts include metal salts, such as calcium chloride, calcium nitrate, barium chloride, magnesium chloride, zinc chloride, aluminium chloride, and aluminium sulfate; and inorganic metal salt polymers, such as polyaluminium chloride, polyaluminium hydroxide, and calcium polysulfide.

The chelating agent may be a water-soluble chelating agent. Examples of such a chelating agent include oxycarboxylic acids, such as tartaric acid, citric acid, and gluconic acid; and aminocarboxylic acids, such as iminodiacetic acid (IDA), nitrilotriacetic acid (NTA), and ethylenediaminetetraacetic acid (EDTA).

The amount of the chelating agent used is preferably 0.01 parts by mass or more and 5.0 parts by mass or less and is more preferably 0.1 parts by mass or more and less than 3.0 parts by mass relative to 100 parts by mass of the resin particles.

Fusion-Coalescence Step

The aggregated particle dispersion liquid in which the aggregated particles are dispersed is heated to, for example, the glass transition temperature of the resin particles or more (e.g., temperature higher than the glass transition temperature of the resin particles by 10° C. to 30° C.) in order to perform fusion and coalescence of the aggregated particles. Hereby, toner particles are prepared.

The toner particles are prepared through the above-described steps.

It is also possible to prepare the toner particles by, after preparing the aggregated particle dispersion liquid in which the aggregated particles are dispersed, further mixing the aggregated particle dispersion liquid with a resin particle dispersion liquid in which resin particles are dispersed and subsequently performing aggregation such that the resin particles are deposited on the surfaces of the aggregated particles in order to form second aggregated particles; and by heating the resulting second-aggregated particle dispersion liquid in which the second aggregated particles are dispersed and thereby causing fusion and coalescence of the second aggregated particles to occur in order to form toner particles having a core-shell structure.

After the completion of the fusion-coalescence step, the toner particles formed in the solution are subjected to any suitable cleaning step, solid-liquid separation step, and drying step that are known in the related art in order to obtain dried toner particles. In the cleaning step, the toner particles may be subjected to displacement washing using ion-exchange water to a sufficient degree from the viewpoint of electrification characteristics. Examples of a solid-liquid separation method used in the solid-liquid separation step include suction filtration and pressure filtration from the viewpoint of productivity. Examples of a drying method used in the drying step include freeze-drying, flash drying, fluidized drying, and vibrating fluidized drying from the viewpoint of productivity.

The toner according to the exemplary embodiment is produced by, for example, adding an external additive to the dried toner particles and mixing the resulting toner particles using a V-blender, a Henschel mixer, a Lodige mixer, or the like. Optionally, coarse toner particles may be removed using a vibrating screen classifier, a wind screen classifier, or the like.

Resin-Coated Carrier

The resin-coated carrier includes magnetic particles and a resin layer covering the magnetic particles.

Magnetic Particles

The magnetic particles are not limited and may be any publicly known magnetic particles used as a core of a carrier particle. Specific examples of the magnetic particles include particles of a magnetic metal, such as iron, nickel, or cobalt; particles of a magnetic oxide, such as ferrite or magnetite; resin-impregnated magnetic particles produced by impregnating porous magnetic powder particles with a resin; and magnetic powder particle-dispersed resin particles produced by dispersing magnetic powder particles in a resin.

The absolute specific gravity of the magnetic particles is preferably 3 g/cm$^3$ or more and 4 g/cm$^3$ or less, is more preferably 3.1 g/cm$^3$ or more and 3.9 g/cm$^3$ or less, and is further preferably 3.2 g/cm$^3$ or more and 3.8 g/cm$^3$ or less. The absolute specific gravity of the magnetic particles may be controlled by, for example, adding a resin to the magnetic particles and changing the amount of the resin.

The absolute specific gravity of the magnetic particles is determined by the pycnometer method described in JIS K0061:2001 "Test methods for density and relative density of chemical products".

The volume-average size of the magnetic particles is, for example, 10 μm or more and 500 μm or less, is preferably 20 μm or more and 180 μm or less, and is more preferably 25 μm or more and 60 μm or less.

The magnetic particles have a magnetic property such that the saturation magnetization of the magnetic particles in a magnetic field of 3,000 Oe is, for example, 50 emu/g or more and is preferably 60 emu/g or more. The saturation magnetization of the magnetic particles is measured using a vibrating sample magnetometer "VSMP10-15" produced by Toei Industry Co., Ltd. The sample to be measured is charged into a cell having an inside diameter of 7 mm and a height of 5 mm, and the cell is attached to the above apparatus. In the measurement, a magnetic field is applied to the sample and the magnetic field is increased to 3,000 Oe at maximum. Subsequently, the magnetic field applied to the sample is reduced. A hysteresis curve is prepared on a recording paper. Saturation magnetization, residual magnetization, and coercive force are determined on the basis of the hysteresis curve.

The volume resistivity (20° C.) of the magnetic particles is, for example, $1\times10^5$ Ω·cm or more and $1\times10^9$ Ω·cm or less and is preferably $1\times10^7$ Ω·cm or more and $1\times10^9$ Ω·cm or less.

The volume resistivity (Ω·cm) of the magnetic particles is determined in the following manner. A sample is placed on a circular electrode plate having an area of 20 cm$^2$ so as to form a flat layer having a thickness of 1 mm or more and 3 mm or less on the electrode plate. Another circular electrode plate having an area of 20 cm$^2$ is stacked on the layer in order to sandwich the layer between the two electrode plates. In order to eliminate the gaps formed inside the sample, a load of 4 kg is applied onto the circular electrode plate disposed above the layer. Subsequently, the thickness (cm) of the layer is measured. The two circular electrode plates between which the layer is vertically sandwiched are connected to an electrometer and a high-voltage power generator. A high voltage is applied between the two circular electrode plates such that an electric field of 103.8 V/cm is generated. The current (A) that flows across the sample is measured. The measurement is conducted at a temperature of 20° C. and a relative humidity of 50%. The volume resistivity (Ω·cm) of the sample is calculated using the following formula.

$$R=E\times20/(I-I_0)/L$$

where R represents the volume resistivity (Ω·cm) of the sample, E represents the voltage applied (V), I represents current (A), $I_0$ represents the current (A) that flows across the sample when the voltage applied is 0 V, and L represents the thickness (cm) of the layer. The coefficient "20" is the area (cm$^2$) of the circular electrode plates.

Resin Layer that Covers Magnetic Particles

Examples of the resin constituting the resin layer include styrene-acrylate copolymers; polyolefin resins, such as polyethylene and polypropylene; polyvinyl and polyvinylidene resins, such as polystyrene, an acrylic resin, polyacrylonitrile, polyvinyl acetate, polyvinyl alcohol, polyvinyl butyral, polyvinyl chloride, polyvinyl carbazole, polyvinyl ether, and polyvinyl ketone; vinyl chloride-vinyl acetate copolymers; silicone resins, such as a straight silicone resin including an organosiloxane bond and a silicone resin produced by modifying the straight silicone resin; fluororesins, such as polytetrafluoroethylene, polyvinyl fluoride, polyvinylidene fluoride, and polychlorotrifluoroethylene; polyesters; polyurethanes; polycarbonates; amino resins, such as a urea-formaldehyde resin; and epoxy resins.

The resin layer may include a silicone resin in order to reduce the difference between the densities of images formed at different speeds. The silicone resin may be a straight silicone resin including an organosiloxane bond.

The ratio of the amount of the silicone resin to the total amount of all the resins included in the resin layer is preferably 80% by mass or more and is more preferably 90% by mass or more. It is further preferable that substantially all the resins included in the resin layer be silicone resins.

The resin layer may include inorganic particles in order to control charging and resistance. Examples of the inorganic particles include particles of carbon black; particles of metals, such as gold, silver, and copper; particles of metal compounds, such as barium sulfate, aluminum borate, potassium titanate, titanium oxide, zinc oxide, tin oxide, antimony-doped tin oxide, tin-doped indium oxide, and aluminum-doped zinc oxide; and resin particles coated with a metal.

For forming the resin layer on the surfaces of the magnetic particles, for example, a wet process and a dry process may be used. In the wet process, the resin that constitutes the resin layer is dissolved or dispersed in a solvent, while such a solvent is not used in the dry process.

Examples of the wet process include the following: an immersion method in which the magnetic particles are immersed in a resin solution used for forming the resin layer (hereinafter, this solution is referred to as "resin layer-forming resin solution") in order to coat the magnetic particles with the resin layer; a spray method in which the resin layer-forming resin solution is sprayed onto the surfaces of the magnetic particles; a fluidized bed method in which the resin layer-forming resin solution is sprayed to the magnetic particles while the magnetic particles are fluidized in a fluidized bed; and a kneader coater method in which the magnetic particles are mixed with the resin layer-forming resin solution in a kneader coater and the solvent is subsequently removed from the resulting mixture.

The resin layer-forming resin solution used in the wet process is prepared by dissolving or dispersing resins and other components in a solvent. The solvent is not limited and may be any solvent in which resins can be dissolved or dispersed. Examples of the solvent include aromatic hydrocarbons, such as toluene and xylene; ketones, such as acetone and methyl ethyl ketone; and ethers, such as tetrahydrofuran and dioxane.

An example of the dry process is a method in which a mixture of the magnetic particles and the resin layer-forming resin is heated under a dry condition to form the resin layer. Specifically, for example, the magnetic particles and the resin layer-forming resin are mixed with each other in a gas phase. The resulting mixture is heated to melt and form the resin layer.

The thickness of the resin layer is preferably 0.1 μm or more and 10 μm or less and is more preferably 0.3 μm or more and 5 μm or less.

The coverage of the resin layer on the surfaces of the resin-coated carrier particles is, for example, 80% or more and 100% or less or 90% or more and 100% or less.

The coverage of the resin layer on the surfaces of the resin-coated carrier particles is determined by the following method using X-ray photoelectron spectroscopy (XPS).

The resin-coated carrier to be analyzed is prepared. In addition, magnetic particles are prepared by removing the resin layer from the resin-coated carrier. The resin layer may be removed from the resin-coated carrier by, for example, dissolving the resin component with an organic solvent or heating the resin-coated carrier at about 800° C. to destroy the resin component. The resin-coated carrier and the magnetic particles from which the resin layer has been removed are used as samples that are to be analyzed. The Fe contents (atomic %) in the resin-coated carrier and the magnetic particles from which the resin layer has been removed are measured by XPS. [Fe content in resin-coated carrier]/[Fe content in magnetic particles)×100 is calculated to determine the ratio (%) at which the magnetic particles are exposed at the surfaces of the resin-coated carrier particles. Thus, [100−Ratio at which magnetic particles are exposed] is considered as a coverage (%) of the resin layer.

The coverage of the resin layer on the surfaces of the resin-coated carrier particles may be controlled by changing the amount of the resin used for forming the resin layer; the higher the proportion of the resin to the magnetic particles, the higher the coverage.

Properties of Resin-Coated Carrier

The volume-average size of the resin-coated carrier particles is preferably 15 μm or more and 510 μm or less, is more preferably 20 μm or more and 180 μm or less, and is further preferably 25 μm or more and 60 μm or less.

The resin-coated carrier has a magnetic property such that the saturation magnetization of the resin-coated carrier in a magnetic field of 1,000 Oe is, for example, 40 emu/g or more and is preferably 50 emu/g or more. The saturation magnetization of the resin-coated carrier is determined as in the measurement of the saturation magnetization of the magnetic particles, except that, in the measurement, the magnetic field is increased to 1,000 Oe at maximum.

The volume resistivity (20° C.) of the resin-coated carrier is, for example, $1\times10^{7}$ Ω·cm or more and $1\times10^{15}$ Ω·cm or less, is preferably $1\times10^{8}$ Ω·cm or more and $1\times10^{14}$ Ω·cm or less, and is more preferably $1\times10^{8}$ Ω·cm or more and $1\times10^{13}$ Ω·cm or less. The volume resistivity of the resin-coated carrier is measured as in the measurement of the volume resistivity of the magnetic particles.

Image Forming Apparatus and Image Forming Method

The image forming apparatus and the image forming method according to an exemplary embodiment are described below.

The image forming apparatus according to the exemplary embodiment includes an image holding member; a charging unit that charges the surface of the image holding member; an electrostatic-image formation unit that forms an electrostatic image on the surface of the image holding member charged; a developing unit that includes an electrostatic-image developer and develops the electrostatic image formed on the surface of the image holding member using the electrostatic-image developer to form a toner image; a transfer unit that transfers the toner image formed on the surface of the image holding member onto the surface of a recording medium; and a fixing unit that fixes the toner image onto the surface of the recording medium. The electrostatic-image developer according to the above-described exemplary embodiment is used as an electrostatic-image developer.

The image forming apparatus according to the exemplary embodiment uses an image forming method (image forming method according to the exemplary embodiment) including charging the surface of the image holding member; forming an electrostatic image on the surface of the charged image holding member; developing the electrostatic image formed on the surface of the image holding member using the electrostatic-image developer according to the above-described exemplary embodiment to form a toner image; transferring the toner image formed on the surface of the image holding member onto the surface of a recording medium; and fixing the toner image onto the surface of the recording medium.

The image forming apparatus according to the exemplary embodiment may be any image forming apparatus known in the related art, such as a direct-transfer-type image forming apparatus in which a toner image formed on the surface of the image holding member is directly transferred to a recording medium; an intermediate-transfer-type image forming apparatus in which a toner image formed on the surface of the image holding member is transferred onto the surface of the intermediate transfer body in the first transfer step and the toner image transferred on the surface of the intermediate transfer body is again transferred onto the surface of a recording medium in the second transfer step; an image forming apparatus including a cleaning unit that cleans the surface of the image holding member subsequent to transfer of the toner image before the image holding member is again charged; and an image forming apparatus including a static-eliminating unit that eliminates static by irradiating, after the toner image has been transferred, the surface of the image holding member to be again charged with static-eliminating light.

In the case where the image forming apparatus according to the exemplary embodiment is the intermediate-transfer-type image forming apparatus, the transfer unit may be constituted by, for example, an intermediate transfer body to which a toner image is transferred, a first transfer subunit that transfers a toner image formed on the surface of the image holding member onto the surface of the intermediate transfer body in the first transfer step, and a second transfer subunit that transfers the toner image transferred on the surface of the intermediate transfer body onto the surface of a recording medium in the second transfer step.

In the image forming apparatus according to the exemplary embodiment, for example, a portion including the developing unit may have a cartridge structure (i.e., process cartridge) detachably attachable to the image forming apparatus. An example of the process cartridge is a process cartridge including a developing unit and the electrostatic-image developer according to the above-described exemplary embodiment.

An example of the image forming apparatus according to the exemplary embodiment is described below, but the image forming apparatus is not limited thereto. Hereinafter, only components illustrated in drawings are described; others are omitted.

FIG. 1 schematically illustrates the image forming apparatus according to the exemplary embodiment.

The image forming apparatus illustrated in FIG. 1 includes first to fourth electrophotographic image formation units 10Y, 10M, 10C, and 10K that form yellow (Y), magenta (M), cyan (C), and black (K) images, respectively, on the basis of color separation image data. The image formation units (hereafter, referred to simply as "units") 10Y, 10M, 10C, and 10K are horizontally arranged in parallel at a predetermined distance from one another. The units 10Y, 10M, 10C, and 10K may be process cartridges detachably attachable to the image forming apparatus.

An intermediate transfer belt (example of the intermediate transfer body) 20 runs above and extends over the units 10Y, 10M, 10C, and 10K. The intermediate transfer belt 20 is wound around a drive roller 22 and a support roller 24 and runs clockwise in FIG. 1, i.e., in the direction from the first unit 10Y to the fourth unit 10K. Using a spring or the like (not illustrated), a force is applied to the support roller 24 in a direction away from the drive roller 22, thereby applying tension to the intermediate transfer belt 20 wound around the drive roller 22 and the support roller 24. An intermediate transfer body-cleaning device 30 is disposed so as to come into contact with the image holding member-side surface of the intermediate transfer belt 20 and to face the drive roller 22.

Developing devices (i.e., examples of the developing units) 4Y, 4M, 4C, and 4K of units 10Y, 10M, 10C, and 10K are supplied with yellow, magenta, cyan, and black toners stored in toner cartridges 8Y, 8M, 8C, and 8K, respectively.

Since the first to fourth units 10Y, 10M, 10C, and 10K have the same structure and the same action, the following description is made with reference to, as a representative, the first unit 10Y that forms an yellow image and is located upstream in a direction in which the intermediate transfer belt runs.

The first unit 10Y includes a photosensitive member 1Y serving as an image holding member. The following components are disposed around the photosensitive member 1Y sequentially in the counterclockwise direction: a charging roller (example of the charging unit) 2Y that charges the surface of the photosensitive member 1Y at a predetermined potential; an exposure device (example of the electrostatic-image formation unit) 3 that forms an electrostatic image by irradiating the charged surface of the photosensitive member 1Y with a laser beam 3Y based on a color separated image signal; a developing device (example of the developing unit) 4Y that develops the electrostatic image by supplying a charged toner to the electrostatic image; a first transfer roller (example of the first transfer subunit) 5Y that transfers the developed toner image to the intermediate transfer belt 20; and a photosensitive-member cleaning device (example of the cleaning unit) 6Y that removes a toner remaining on the surface of the photosensitive member 1Y after the first transfer.

The first transfer roller 5Y is disposed so as to be in contact with the inner surface of the intermediate transfer belt 20 and to face the photosensitive member 1Y. Each of the first transfer rollers 5Y, 5M, 5C, and 5K of the respective units is connected to a bias power supply (not illustrated) that applies a first transfer bias to the first transfer rollers. Each bias power supply varies the transfer bias applied to the corresponding first transfer roller on the basis of the control by a controller (not illustrated).

The action of forming a yellow image in the first unit 10Y is described below.

Before the action starts, the surface of the photosensitive member 1Y is charged at a potential of −600 to −800 V by the charging roller 2Y.

The photosensitive member 1Y is formed by stacking a photosensitive layer on a conductive substrate (e.g., volume resistivity at 20° C.: $1\times10^{-6}$ Ωcm or less). The photosensitive layer is normally of high resistance (comparable with the resistance of ordinary resins), but, upon being irradiated with the laser beam, the specific resistance of the portion irradiated with the laser beam varies. Thus, the exposure device 3 irradiates the surface of the charged photosensitive member 1Y with the laser beam 3Y on the basis of the image data of the yellow image sent from the controller (not illustrated). As a result, an electrostatic image of yellow image pattern is formed on the surface of the photosensitive member 1Y.

The term "electrostatic image" used herein refers to an image formed on the surface of the photosensitive member 1Y by charging, the image being a "negative latent image" formed by irradiating a portion of the photosensitive layer with the laser beam 3Y to reduce the specific resistance of the irradiated portion such that the charges on the irradiated surface of the photosensitive member 1Y discharge while the charges on the portion that is not irradiated with the laser beam 3Y remain.

The electrostatic image, which is formed on the photosensitive member 1Y as described above, is sent to the predetermined developing position by the rotating photosensitive member 1Y. The electrostatic image on the photosensitive member 1Y is developed and visualized in the form of a toner image by the developing device 4Y at the developing position.

The developing device 4Y includes an electrostatic-image developer including, for example, at least, a yellow toner and a carrier. The yellow toner is stirred in the developing device 4Y to be charged by friction and supported on a developer roller (example of the developer support), carrying an electric charge of the same polarity (i.e., negative) as the electric charge generated on the photosensitive member 1Y. The yellow toner is electrostatically adhered to the eliminated latent image portion on the surface of the photosensitive member 1Y as the surface of the photosensitive member 1Y passes through the developing device 4Y. Thus, the latent image is developed using the yellow toner. The photosensitive member 1Y on which the yellow toner image is formed keeps rotating at the predetermined rate, thereby transporting the toner image developed on the photosensitive member 1Y to the predetermined first transfer position.

Upon the yellow toner image on the photosensitive member 1Y reaching the first transfer position, first transfer bias is applied to the first transfer roller 5Y so as to generate an electrostatic force on the toner image in the direction from the photosensitive member 1Y toward the first transfer roller 5Y. Thus, the toner image on the photosensitive member 1Y is transferred to the intermediate transfer belt 20. The transfer bias applied has the opposite polarity (+) to that of the toner (−) and controlled to be, in the first unit 10Y, for example, +10 μA by a controller (not illustrated).

The toner remaining on the photosensitive member 1Y is removed by the photosensitive-member cleaning device 6Y and then collected.

Each of the first transfer biases applied to first transfer rollers 5M, 5C, and 5K of the second, third, and fourth units 10M, 10C, and 10K is controlled in accordance with the first unit 10Y.

Thus, the intermediate transfer belt 20, on which the yellow toner image is transferred in the first unit 10Y, is successively transported through the second to fourth units 10M, 10C, and 10K while toner images of the respective colors are stacked on top of another.

The resulting intermediate transfer belt 20 on which toner images of four colors are multiple-transferred in the first to fourth units is then transported to a second transfer section including a support roller 24 being in contact with the inner surface of the intermediate transfer belt 20 and a second transfer roller (example of the second transfer subunit) 26 disposed on the image holding member-side of the intermediate transfer belt 20. A recording paper (example of the recording medium) P is fed by a feed mechanism into a narrow space between the second transfer roller 26 and the intermediate transfer belt 20 that are brought into contact with each other at the predetermined timing. The second transfer bias is then applied to the support roller 24. The transfer bias applied here has the same polarity (−) as that of the toner (−) and generates an electrostatic force on the toner image in the direction from the intermediate transfer belt 20 toward the recording paper P. Thus, the toner image on the intermediate transfer belt 20 is transferred to the recording paper P. The intensity of the second transfer bias applied is determined on the basis of the resistance of the second transfer section which is detected by a resistance detector (not illustrated) that detects the resistance of the second transfer section and controlled by changing voltage.

Subsequently, the recording paper P is transported into a nip part of the fixing device (example of the fixing unit) 28 at which a pair of fixing rollers are brought into contact with each other. The toner image is fixed to the recording paper P to form a fixed image.

Examples of the recording paper P to which a toner image is transferred include plain paper used in electrophotographic copiers, printers, and the like. Instead of the recording paper P, OHP films and the like may be used as a recording medium.

The surface of the recording paper P may be smooth in order to enhance the smoothness of the surface of the fixed image. Examples of such a recording paper include coated paper produced by coating the surface of plain paper with resin or the like and art paper for printing.

The recording paper P, to which the color image has been fixed, is transported toward an exit portion. Thus, the series of the steps for forming a color image are terminated.

Process Cartridge

The process cartridge according to an exemplary embodiment is described below.

The process cartridge according to the exemplary embodiment includes a developing unit that includes the electrostatic-image developer according to the above-described exemplary embodiment and develops an electrostatic image formed on the surface of an image holding member using the electrostatic-image developer to form a toner image. The process cartridge according to the exemplary embodiment is detachably attachable to an image forming apparatus.

The structure of the process cartridge according to the exemplary embodiment is not limited to the above-described one. The process cartridge according to the exemplary embodiment may further include, in addition to the developing unit, at least one unit selected from an image holding member, a charging unit, an electrostatic-image formation unit, a transfer unit, and the like as needed.

An example of the process cartridge according to the exemplary embodiment is described below, but the process cartridge is not limited thereto. Hereinafter, only components illustrated in FIG. 2 are described; others are omitted.

Figure 2:
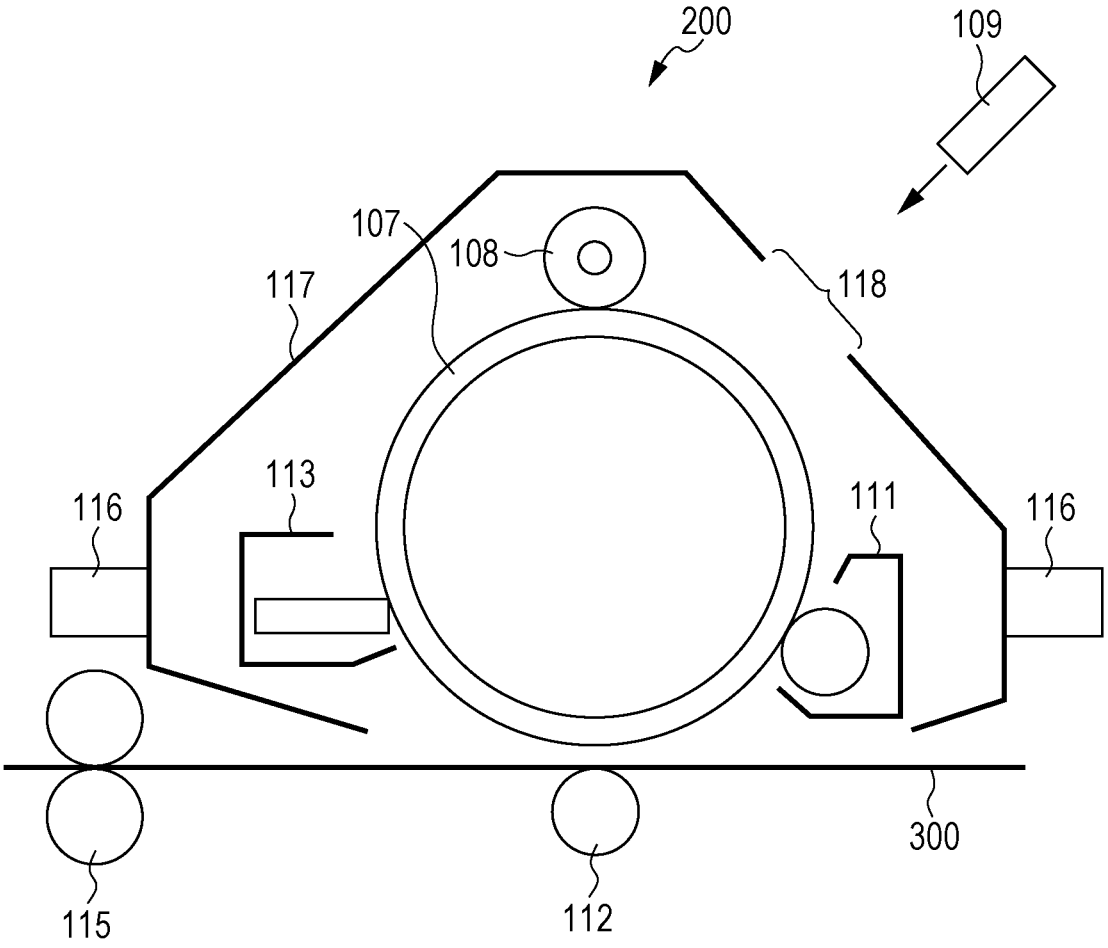
FIG. 2 is a schematic diagram illustrating an example of a process cartridge detachably attachable to an image forming apparatus according to an exemplary embodiment.

FIG. 2 schematically illustrates the process cartridge according to the exemplary embodiment.

A process cartridge 200 illustrated in FIG. 2 includes, for example, a photosensitive member 107 (example of the image holding member), a charging roller 108 (example of the charging unit) disposed on the periphery of the photosensitive member 107, a developing device 111 (example of the developing unit), and a photosensitive-member-cleaning device 113 (example of the cleaning unit), which are combined into one unit using a housing 117 to form a cartridge. The housing 117 has an aperture 118 for exposure. A mounting rail 116 is disposed on the housing 117.

In FIG. 2, Reference numeral 109 denotes an exposure device (example of the electrostatic-image formation unit), Reference numeral 112 denotes a transfer device (example of the transfer unit), Reference numeral 115 denotes a fixing device (example of the fixing unit), and the Reference numeral 300 denotes recording paper (example of the recording medium).

EXAMPLES

The exemplary embodiments of the present disclosure are described below in detail with reference to Examples below. The exemplary embodiments of the present disclosure are not limited to Examples below. Hereinafter, the expression "parts" and "%" mean "parts by mass" and "% by mass", respectively, unless otherwise specified.

Preparation of Amorphous Resin Particle Dispersion Liquid (aHB-1)

A four-necked flask equipped with a nitrogen-gas-introduction pipe, a stirrer, and a temperature sensor is purged with nitrogen. Into the flask, 5,670 parts of polyoxypropylene(2.2)-2,2-bis(4-hydroxyphenyl)propane, 585 parts of polyoxyethylene(2.0)-2,2-bis(4-hydroxyphenyl)propane, 2,450 parts of terephthalic acid, 44 parts of di(2-ethylhexanoic acid), and $_{100}$ parts of vinyl alcohol are charged. Under a nitrogen atmosphere, the resulting mixture is heated to 235° C. and held for 5 hours while being stirred. Subsequently, the pressure inside the flask is reduced to 8.0 kPa. The flask is held for 1 hour at 8.0 kPa. After the pressure inside the flask has been increased to atmospheric pressure, the temperature is reduced to 190° C. Subsequently, 42 parts of fumaric acid and 207 parts of trimellitic acid are added to the flask. After the flask has been held at 190° C. for 2 hours, the temperature is increased to 210° C. over 2 hours. Then, the pressure inside the flask is reduced to 8.0 kPa, and the flask is held for 4 hours at 8.0 kPa. Hereby, an amorphous polyester resin A (i.e., a polyester segment) is prepared. Into a four-neck flask equipped with a cooling tube, a stirrer, and a temperature sensor, 857 parts of the amorphous polyester resin A is charged. The amorphous polyester resin A is stirred at 200 rpm in a nitrogen atmosphere.

To the flask, 60 parts of styrene, 60 parts of ethyl acrylate, and 500 parts of ethyl acetate, which are addition polymerizable monomers, are added. The resulting mixture is stirred for 30 minutes. Subsequently, 6 parts of a non-ionic surfactant "EMULGEN 147" produced by Kao Corporation, 40 parts of a 15% aqueous solution of sodium dodecylbenzenesulfonate, that is, an anionic surfactant "NEOPELEX G-15" produced by Kao Corporation, and 233 parts of 5% potassium hydroxide are charged into the flask. While stirring is performed, the temperature is increased to 95° C. in order to perform melting. The mixture is stirred at 95° C. for 2 hours to form a resin mixture solution. While the resin mixture solution is stirred, 1,145 parts of deionized water is added dropwise to the flask at a rate of 6 part/min. Hereby, an emulsion is formed. The emulsion is cooled to 25° C. and then passed through a 200-mesh metal screen. Subsequently, deionized water is added in order to adjust the solid content of the resulting dispersion liquid to be 20%. Hereby, an amorphous resin particle dispersion liquid (aHB-1) is prepared.

The amorphous resin particle dispersion liquid (aHB-1) is a dispersion liquid that contains hybrid amorphous resin particles dispersed therein. The mass ratio of the styrene acrylate segment of the hybrid amorphous resin included in the amorphous resin particle dispersion liquid (aHB-1) to the polyester segment of the hybrid amorphous resin ([Styrene acrylate segment]:[Polyester segment]) is 10:90. The hybrid amorphous resin has a weight-average molecular weight of 16,000 and a glass transition temperature of 62° C. Preparation of Amorphous Resin Particle Dispersion Liquid (aHB-2)

An amorphous resin particle dispersion liquid (aHB-2) is prepared as in the preparation of the amorphous resin particle dispersion liquid (aHB-1), except that 6 parts of the non-ionic surfactant "EMULGEN 147" produced by Kao Corporation which is used in the preparation of the amorphous resin particle dispersion liquid (aHB-1) is replaced with 6 parts of an anionic surfactant "NEOGEN SC" produced by Dai-ichi Kogyo Seiyaku Co., Ltd.

The amorphous resin particle dispersion liquid (aHB-2) is a dispersion liquid that contains hybrid amorphous resin particles dispersed therein. The mass ratio of the styrene acrylate segment of the hybrid amorphous resin included in the amorphous resin particle dispersion liquid (aHB-2) to the polyester segment of the hybrid amorphous resin ([Styrene acrylate segment]:[Polyester segment]) is 10:90. The hybrid amorphous resin has a weight-average molecular weight of 16,000 and a glass transition temperature of 60° C. Preparation of Amorphous Resin Particle Dispersion Liquid (aPES)

Ethylene glycol: 37 parts
Neopentyl glycol: 65 parts
1,9-Nonanediol: 32 parts
Terephthalic acid: 96 parts The above materials are charged into a flask and heated to 200° C. over 1 hour. After it has been confirmed that the inside of the reaction system has been stirred uniformly, 1.2 parts of dibutyltin oxide is charged into the flask. While the product water is removed by distillation, the temperature is increased from 200° C. to 240° C. over 6 hours and a dehydration condensation reaction is continued for 4 hours at 240° C. Hereby, an amorphous polyester resin having an acid value of 9.4 mgKOH/g, a weight-average molecular weight of 13,000, and a glass transition temperature of 62° C. is prepared.

While the amorphous polyester resin is in a molten state, the amorphous polyester resin is transferred to a "CAVITRON CD1010" produced by EUROTEC at a rate of 100 g/min. Simultaneously, a 0.37%-dilute ammonia water is also transferred to the CAVITRON CD1010 at a rate of 0.1 L/min while being heated to 120° C. with a heat exchanger. The CAVITRON CD1010 is operated with a rotor rotation speed of 60 Hz and a pressure of 5 kg/cm$^2$. Hereby, an amorphous resin particle dispersion liquid (aPES) having an average particle size of 160 nm and a solid content of 30% is prepared.

Preparation of Crystalline Resin Particle Dispersion Liquid (cPES-1)

Decanedioic acid: 81 parts
Hexanediol: 47 parts

The above materials are charged into a flask and heated to 160° C. over 1 hour. After it has been confirmed that the inside of the reaction system has been stirred uniformly, 0.03 parts of dibutyltin oxide is charged into the flask. While the product water is removed by distillation, the temperature is increased from 160° C. to 200° C. over 6 hours and a dehydration condensation reaction is continued for 4 hours at 200° C. Then, the reaction is terminated. The reaction solution is cooled and then subjected to solid-liquid separation. The resulting solid substance is dried at 40° C. in a vacuum state to form a crystalline polyester resin. The crystalline polyester resin has a melting temperature of 64° C. and a weight-average molecular weight of 15,000.

Crystalline polyester resin: 50 parts
Anionic surfactant "NEOGEN SC" produced by Dai-ichi Kogyo Seiyaku Co., Ltd.: 1.5 parts
Non-ionic surfactant "EMULGEN 147" produced by Kao Corporation: 0.5 parts
Ion-exchange water: 200 parts The above materials are heated to 120° C. and dispersed to a sufficient degree with a homogenizer "ULTRA-TURRAX T50" produced by IKA. A further dispersion treatment is performed using a pressure-discharge-type homogenizer. The resulting dispersion liquid is collected when the volume-average particle size of the dispersion liquid reaches 180 nm. Hereby, a crystalline resin particle dispersion liquid (cPES-1) having a solid content of 20% is prepared. Preparation of Crystalline Resin Particle Dispersion Liquid (cPES-2)

A crystalline resin particle dispersion liquid (cPES-2) is prepared as in the preparation of the crystalline resin particle dispersion liquid (cPES-1), except that 0.5 parts of the non-ionic surfactant "EMULGEN 147" produced by Kao Corporation is not used and the amount of the anionic surfactant "NEOGEN SC" produced by Dai-ichi Kogyo Seiyaku Co., Ltd. is increased by an amount equal to the amount of the non-ionic surfactant "EMULGEN 147" used in the preparation of the crystalline resin particle dispersion liquid (cPES-1). That is, the amount of the anionic surfactant used in the preparation of the crystalline resin particle dispersion liquid (cPES-2) is 2 parts.

Preparation of Crystalline Resin Particle Dispersion Liquid (cHB-1)

Decanedioic acid: 730 parts
Hexanediol: 423 parts
Vinyl alcohol: 45 parts

The above materials are charged into a flask and heated to 160° C. over 1 hour. After it has been confirmed that the inside of the reaction system has been stirred uniformly, 0.03 parts of dibutyltin oxide is charged into the flask. While the product water is removed by distillation, the temperature is increased from 160° C. to 200° C. over 6 hours and a dehydration condensation reaction is continued for 4 hours at 200° C. Then, the reaction is terminated. The reaction solution is cooled and then subjected to solid-liquid separation. The resulting solid substance is dried at 40° C. in a vacuum state to form a crystalline polyester resin.

To the flask, 30 parts of styrene, 100 parts of ethyl acrylate, and 500 parts of ethyl acetate, which are addition polymerizable monomers, are added. The resulting mixture is stirred for 30 minutes. Subsequently, 7.5 parts of a non-ionic surfactant "EMULGEN 147" produced by Kao Corporation, 40 parts of a 15% aqueous solution of sodium dodecylbenzenesulfonate, that is, an anionic surfactant "NEOPELEX G-15" produced by Kao Corporation, and 233 parts of 5% potassium hydroxide are charged into the flask. While stirring is performed, the temperature is increased to 95° C. in order to perform melting. The mixture is stirred at 95° C. for 2 hours to form a resin mixture solution. While the resin mixture solution is stirred, 1,145 parts of deionized water is added dropwise to the flask at a rate of 6 part/min. Hereby, an emulsion is formed. The emulsion is cooled to 25° C. and then passed through a 200-mesh metal screen. Subsequently, deionized water is added in order to adjust the solid content of the resulting dispersion liquid to be 20%. Hereby, a crystalline resin particle dispersion liquid (cHB-1) is prepared.

The crystalline resin particle dispersion liquid (cHB-1) is a dispersion liquid that contains hybrid crystalline resin particles dispersed therein. The hybrid crystalline resin included in the crystalline resin particle dispersion liquid (cHB-1) has a melting temperature of 68° C. and a weight-average molecular weight of 13,000.

Preparation of Crystalline Resin Particle Dispersion Liquid (cHB-2)

A crystalline resin particle dispersion liquid (cHB-2) is prepared as in the preparation of the crystalline resin particle dispersion liquid (cHB-1), except that the non-ionic surfactant "EMULGEN 147" produced by Kao Corporation is not used and the amount of the anionic surfactant "NEOGEN SC" produced by Dai-ichi Kogyo Seiyaku Co., Ltd. is increased by an amount equal to the amount of the non-ionic surfactant "EMULGEN 147" used in the preparation of the crystalline resin particle dispersion liquid (cHB-1).

Preparation of Release-Agent Particle Dispersion Liquid (PF-1)

Paraffin wax "HNP-9" produced by Nippon Seiro Co., Ltd.: 50 parts

Anionic surfactant "NEOGEN SC" produced by Dai-ichi Kogyo Seiyaku Co., Ltd.: 1.5 parts Non-ionic surfactant "EMULGEN 147" produced by Kao Corporation: 0.5 parts Ion-exchange water: 200 parts The above materials are heated to 120° C. and dispersed to a sufficient degree with a homogenizer "ULTRA-TURRAX T50" produced by IKA. A further dispersion treatment is performed using a pressure-discharge-type homogenizer. Hereby, a release-agent particle dispersion liquid (PF-1) having a volume-average particle size of 200 nm and a solid content of 20% is prepared.

Preparation of Release-Agent Particle Dispersion Liquid (PF-2)

A release-agent particle dispersion liquid (PF-2) is prepared as in the preparation of the release-agent particle dispersion liquid (PF-1), except that 0.5 parts of the non-ionic surfactant "EMULGEN 147" produced by Kao Corporation is not used and the amount of the anionic surfactant "NEOGEN SC" produced by Dai-ichi Kogyo Seiyaku Co., Ltd. is increased by an amount equal to the amount of the non-ionic surfactant "EMULGEN 147" used in the preparation of the release-agent particle dispersion liquid (PF-1). That is, the amount of the anionic surfactant used in the preparation of the release-agent particle dispersion liquid (PF-2) is 2 parts.

Preparation of Release-Agent Particle Dispersion Liquid (PE-1)

Polyethylene wax "POLYWAX 725" produced by Baker Hughes: 50 parts

Anionic surfactant "NEOGEN SC" produced by Dai-ichi Kogyo Seiyaku Co., Ltd.: 1.5 parts Non-ionic surfactant "EMULGEN 147" produced by Kao Corporation: 0.5 parts Ion-exchange water: 200 parts The above materials are heated to 120° C. and dispersed to a sufficient degree with a homogenizer "ULTRA-TURRAX T50" produced by IKA. A further dispersion treatment is performed using a pressure-discharge-type homogenizer. Hereby, a release-agent particle dispersion liquid (PE-1) having a volume-average particle size of 200 nm and a solid content of 20% is prepared.

Preparation of Release-Agent Particle Dispersion Liquid (PE-2)

A release-agent particle dispersion liquid (PE-2) is prepared as in the preparation of the release-agent particle dispersion liquid (PE-1), except that 0.5 parts of the non-ionic surfactant "EMULGEN 147" produced by Kao Corporation is not used and the amount of the anionic surfactant "NEOGEN SC" produced by Dai-ichi Kogyo Seiyaku Co., Ltd. is increased by an amount equal to the amount of the non-ionic surfactant "EMULGEN 147" used in the preparation of the release-agent particle dispersion liquid (PE-1). That is, the amount of the anionic surfactant used in the preparation of the release-agent particle dispersion liquid (PE-2) is 2 parts.

Preparation of Colorant Particle Dispersion Liquid (1)

Cyan pigment "Pigment Blue 15:3" produced by Dainichiseika Color & Chemicals Mfg. Co., Ltd.: 10 parts Anionic surfactant "NEOGEN SC" produced by Dai-ichi Kogyo Seiyaku Co., Ltd.: 2 parts Ion-exchange water: 80 parts The above materials are mixed with one another. The resulting mixture is subjected to a dispersion treatment using a high-pressure-impact-type disperser Ultimaizer "HJP30006" produced by Sugino Machine Limited for 1 hour to form a colorant particle dispersion liquid (1) having a volume-average particle size of 180 nm and a solid content of 20%.

Preparation of Toner Particles (1) and Toner (1)

Amorphous resin particle dispersion liquid (aHB-1): 150 parts

Crystalline resin particle dispersion liquid (cPES-1): 50 parts

Release-agent particle dispersion liquid (PF-1): 35 parts

Colorant particle dispersion liquid (1): 25 parts

Polyaluminum chloride: 0.4 parts

Ion-exchange water: 100 parts

The above materials are charged into a round stainless steel flask and subjected to a dispersion treatment using a homogenizer "ULTRA-TURRAX T50" produced by IKA. Subsequently, the flask is heated to 48° C. while the contents of the flask are stirred in an oil bath for heating. Then, holding is performed for 60 minutes. Subsequently, 70 parts of the amorphous resin particle dispersion liquid (aHB-1) is slowly added to the flask. After the pH of the system has been adjusted to be 8.0 using an aqueous sodium hydroxide solution having a concentration of 0.5 mol/L, the stainless steel flask is hermetically sealed and the stirrer shaft is magnetically sealed. While stirring is continued, the flask is heated to 90° C. and held for 30 minutes. Subsequently, cooling is performed at a cooling rate of 5° C./min. Subsequently, the resulting solid component is obtained by filtration and sufficiently washed with ion-exchange water. Then, solid-liquid separation is performed by Nutsche suction filtration. The solid component is again dispersed in ion-exchange water having a temperature of 30° C. The resulting dispersion liquid is stirred at a rotation speed of 300 rpm for 15 minutes in order to perform washing. This washing operation is further performed six times. When the pH of the filtrate reaches 7.54 and the electric conductivity of the filtrate reaches 6.5 μS/cm, solid-liquid separation is performed by Nutsche suction filtration using the filter paper No. 5A. The resulting solid component is vacuum-dried for 24 hours to form toner particles. The volume-average size D50v of the toner particles is 5.7 μm.

To the toner particles, silica particles having an average primary particle size of 40 nm which have been subjected to a hydrophobic surface treatment using hexamethyldisilazane and particles of a metatitanic acid compound that is produced by reaction of a metatitanic acid with isobutyltrimethoxysilane which have an average primary particle size of 20 nm are added such that the coverage of the two types of particles on the surfaces of the toner particles is 40%. The resulting mixture is stirred with a Henschel mixer to form a toner (1).

Preparation of Toner Particles (2) to (10) and Toners (2) to (10)

Each of the toner particle samples (2) to (10) is prepared as in the preparation of the toner particles (1), except that at least one of the amorphous resin particle dispersion, the crystalline resin particle dispersion, and the release-agent particle dispersion is changed as described in Table 1.

Toners (2) to (10) are prepared as in the preparation of the toner (1), except that the toner particle samples (2) to (10), respectively, are used instead.

TABLE 1

| Toner particles toner | Amorphous-resin particle dispersion liquid | Crystalline-resin particle dispersion liquid | Release-agent particle dispersion liquid | Amorphous resin | Crystalline resin | Release agent | Use of non-ionic surfactant | D50v of toner particles [μm] |
|---|---|---|---|---|---|---|---|---|
| (1) | (aHB-1) | (cPES-1) | (PF-1) | PES-StAc | PES | Paraffin | Yes | 5.7 |
| (2) | (aPES) | (cPES-1) | (PF-1) | PES | PES | Paraffin | Yes | 5.6 |
| (3) | (aHB-1) | (cPES-1) | (PE-1) | PES-StAc | PES | Polyethylene | Yes | 5.7 |
| (4) | (aHB-2) | (cPES-2) | (PF-2) | PES-StAc | PES | Paraffin | No | 5.6 |
| (5) | (aHB-2) | (cPES-2) | (PE-2) | PES-StAc | PES | Polyethylene | No | 5.7 |
| (6) | (aHB-1) | (cHB-1) | (PF-1) | PES-StAc | PES-StAc | Paraffin | Yes | 5.7 |
| (7) | (aPES) | (cHB-1) | (PF-1) | PES | PES-StAc | Paraffin | Yes | 5.7 |
| (8) | (aHB-1) | (cHB-1) | (PE-1) | PES-StAc | PES-StAc | Polyethylene | Yes | 5.8 |
| (9) | (aHB-2) | (cHB-2) | (PF-2) | PES-StAc | PES-StAc | Paraffin | No | 5.8 |
| (10) | (aHB-2) | (cHB-2) | (PE-2) | PES-StAc | PES-StAc | Polyethylene | No | 5.8 |

Preparation of Magnetic Particles (1)

Phenol: 40 parts

Formalin: 60 parts

Magnetite (volume-average particle size: 0.2 μm): 400 parts

Ion-exchange water: 60 parts

Ammonia water: 12 parts

The above materials are mixed with one another. While the resulting mixture is stirred, the mixture is heated to 85° C. and reacted for 4 hours to form a cured product. Subsequently, cooling, solid-liquid separation by filtration, and washing with ion-exchange water are performed. Then, the temperature is increased to 180° C. to perform drying. Hereby, magnetic particles (1) composed of a phenol resin in which a magnetic material is dispersed are prepared. The magnetic particles (1) have a volume-average size D50v of 38 μm and an absolute specific gravity of 3.7 g/cm$^3$.

Preparation of Magnetic Particles (2)

$Fe(OH)_3$: 1,000 parts $MnO_2$: 4.5 parts $Mg(OH)_2$: 40 parts

The above materials are mixed with one another. A dispersant, water, polyvinyl alcohol, and polymethyl methacrylate particles having a volume-average size of 2 μm are added to the resulting mixture. Subsequently, the mixture is stirred using zirconia beads having a medium diameter of 1 mm. Then, granulation and drying is performed using a spray dryer such that the resulting particles have a volume-average size of 40 μm. The dried particles are baked in an electric furnace at 1,200° C. for 4 hours in an oxygen-nitrogen mixed atmosphere. The oxygen concentration in the oxygen-nitrogen mixed atmosphere is adjusted to be 1% by volume. Subsequent to the baking, the baked material is disintegrated and classified. Hereby, magnetic particles (2) are prepared. The magnetic particles (2) have a volume-average size D50v of 38 μm and an absolute specific gravity of 3.4 g/cm$^3$.

Preparation of Magnetic Particles (3)

$Fe(OH)_3$: 1,000 parts $MnO_2$: 4.5 parts $Mg(OH)_2$: 40 parts

The above materials are mixed with one another. A dispersant, water, and polyvinyl alcohol are added to the resulting mixture. Subsequently, the mixture is stirred using zirconia beads having a medium diameter of 1 mm. Then, granulation and drying is performed using a spray dryer such that the resulting particles have a volume-average size of 39 μm. The dried particles are baked in an electric furnace at 1,400° C. for 6 hours in an oxygen-nitrogen mixed atmosphere. The oxygen concentration in the oxygen-nitrogen mixed atmosphere is adjusted to be 1% by volume. Subsequent to the baking, the baked material is disintegrated and classified. Hereby, magnetic particles (3) are prepared. The magnetic particles (3) have a volume-average size D50v of 38 μm and an absolute specific gravity of 4.6 g/cm$^3$.

Preparation of Coating Composition (1)

Silicone resin solution "5R2410" produced by Dow Corning Toray Silicone Co., Ltd.: 100 parts Toluene: 300 parts The above material are mixed with each other to form a coating composition (1).

Preparation of Coating Composition (2)

Cyclohexyl methacrylate resin (weight-average molecular weight: 50,000): 36 parts Carbon black "VXC72" produced by Cabot Corporation: 4 parts Toluene: 300 parts The above materials and glass beads (particle size: 1 mm, in an amount equal to the amount of toluene) are charged into a sand mill produced by Kansai Paint Co., Ltd. The resulting mixture is stirred at a rotation speed of 1,200 rpm for 30 minutes. Hereby, a coating composition (2) having a solid content of 11% is prepared.

Preparation of Resin-Coated Carrier (1)

Into a tumbling fluid bed coater "MP01-SFP" produced by Powrex Corporation, 1,000 parts of the magnetic particles (1) are charged. Coating is performed under the following conditions such that the coverage of the coating composition (1) is 98.5%: screen mesh size: 0.5 mm, impeller rotation speed: 1,000 rpm, outlet air flow rate: 1.2 $m^3$/min, coating speed: 10 g/min, temperature: 80° C. Hereby, a resin-coated carrier (1) is prepared.

Preparation of Resin-Coated Carrier (2)

A resin-coated carrier (2) is prepared as in the preparation of the carrier (1), except that the magnetic particles (2) are used instead of the magnetic particles (1), and the coverage of the coating composition is changed to 97.0%.

Preparation of Resin-Coated Carrier (3)

A resin-coated carrier (3) is prepared as in the preparation of the carrier (1), except that the magnetic particles (3) are used instead of the magnetic particles (1), and the coverage of the coating composition is changed to 97.5%.

Preparation of Resin-Coated Carrier (4)

A resin-coated carrier (4) is prepared as in the preparation of the carrier (1), except that the coating composition (2) is used instead of the coating composition (1).

TABLE 2

| Resin-coated carrier | Magnetic particles | | | | Coating composition | Resin layer | Absolute specific gravity of carrier [g/cm$^3$] |
|---|---|---|---|---|---|---|---|
| | Type | Material | D50v [μm] | Absolute specific gravity [g/cm$^3$] | | | |
| (1) | (1) | Particles of resin in which magnetite particles are dispersed | 38 | 3.7 | (1) | Silicone resin | 3.6 |
| (2) | (2) | Ferrite particles | 38 | 3.4 | (1) | Silicone resin | 3.3 |
| (3) | (3) | Ferrite particles | 38 | 4.6 | (1) | Silicone resin | 4.5 |
| (4) | (1) | Particles of resin in which magnetite particles are dispersed | 38 | 3.7 | (2) | Cyclohexyl methacrylate resin | 3.6 |

Example 1

The resin-coated carrier (1) and the toner (1) are charged into a V-blender such that the proportion of the carrier to the toner [Carrier:Toner] is 100:8 by mass. The resulting mixture is stirred for 20 minutes to form a developer.

Examples 2 to 18

A developer is prepared as in Example 1, except that the combination of the toner and the resin-coated carrier is changed as described in Table 3.

Comparative Examples 1 to 10

A developer is prepared as in Example 1, except that the combination of the toner and the resin-coated carrier is changed as described in Table 3.

Performance Evaluation

A specific one of the developers prepared in Examples and Comparative examples is charged into a cyan developing apparatus of a modification of DocuCentreC400 produced by Fuji Xerox Co., Ltd. which has been modified such that the printing speed can be changed as needed and the ratio between the peripheral speeds of the photosensitive member and the sleeve of the developing apparatus is constant.

A cyan image with 5-centimeter sides is formed on an A4-size plain paper sheet with an image density of 100% at a temperature of 30° C. and a relative humidity of 85% (hereinafter, this paper sheet is referred to as "printed material 1").

Subsequently, a cyan image is sequentially formed on 100,000 A4-size plain paper sheets with an image density of 1% at a temperature of 30° C. and a relative humidity of 85%.

Then, a cyan image with 5-centimeter sides is formed on an A4-size plain paper sheet with an image density of 100% at a temperature of 30° C. and a relative humidity of 85% (hereinafter, this paper sheet is referred to as "printed material 2").

Subsequently, after the printing speed has been reduced by half, a cyan image is formed on 10 A4-size plain paper sheets with an image density of 1% at a temperature of 30° C. and a relative humidity of 85%.

Then, a cyan image with 5-centimeter sides is formed on an A4-size plain paper sheet with an image density of 100% at a temperature of 30° C. and a relative humidity of 85% (hereinafter, this paper sheet is referred to as "printed material 3").

The hue of each of the 5-centimeter-square images is measured with a spectrocolorimeter "RM200QC" produced by X-Rite, Inc. The color difference ΔE between the printed materials 1 and 2 (hereinafter, this color difference is referred to as "ΔE1") and the color difference ΔE between the printed materials 1 and 3 (hereinafter, this color difference is referred to as "ΔE2") are calculated using the following formula.

$$\Delta E = \sqrt{(L_1 - L_2)^2 + (a_1 - a_2)^2 + (b_1 - b_2)^2}$$

where $L_1$, $a_1$, and $b_1$ represent the L* value, the a* value, and the b* value of the printed material 1, and $L_2$, $a_2$, and $b_2$ represent the L* value, the a* value, and the b* value of the printed material 2 or 3.

The value ΔE1-ΔE2 is calculated from ΔE1 and ΔE2, and the absolute value of ΔE1−ΔE2 is used as a measure of the difference in image density. Table 3 summarizes the evaluation results.

A: |ΔE1-ΔE2| is 0.5 or less

B: |ΔE1-ΔE2| is more than 0.5 and less than 1.0

C: |ΔE1-ΔE2| is more than 1.0 and less than 2.0

D: |ΔE1-ΔE2| is more than 2.0

TABLE 3

| | Toner | Resin-coated carrier | Toner particles: Amorphous resin | Toner particles: Crystalline resin | Toner particles: Release agent | Resin-coated carrier: Magnetic particles | Resin-coated carrier: Resin layer | Absolute specific gravity [g/cm$^3$] | Proportion of non-ionic surfactant to carrier [ppm] | Evaluation |
|---|---|---|---|---|---|---|---|---|---|---|
| Example 1 | (1) | (1) | PES-StAc | PES | Paraffin | Particles of resin in which magnetite particles are dispersed | Silicone resin | 3.6 | 3.1 | A |
| Example 2 | (1) | (2) | PES-StAc | PES | Paraffin | Ferrite particles | Silicone resin | 3.3 | 3.1 | B |
| Example 3 | (1) | (4) | PES-StAc | PES | Paraffin | Particles of resin in which magnetite particles are dispersed | Cyclohexyl methacrylate resin | 3.6 | 3.1 | B |
| Comparative example 1 | (4) | (1) | PES-StAc | PES | Paraffin | Particles of resin in which magnetite particles are dispersed | Silicone resin | 3.6 | Beyond detection | D |
| Comparative example 2 | (1) | (3) | PES-StAc | PES | Paraffin | Ferrite particles | Silicone resin | 4.5 | 3.1 | D |
| Example 4 | (2) | (1) | PES | PES | Paraffin | Particles of resin in which magnetite particles are dispersed | Silicone resin | 3.6 | 2.3 | C |
| Example 5 | (2) | (2) | PES | PES | Paraffin | | Silicone resin | 3.3 | 2.3 | C |
| Example 6 | (2) | (4) | PES | PES | Paraffin | Particles of resin in which magnetite particles are dispersed | Cyclohexyl methacrylate resin | 3.6 | 2.3 | C |
| Comparative example 3 | (2) | (3) | PES | PES | Paraffin | Ferrite particles | Silicone resin | 4.5 | 2.3 | D |
| Example 7 | (3) | (1) | PES-StAc | PES | Polyethylene | Particles of resin in which magnetite particles are dispersed | Silicone resin | 3.6 | 3.1 | B |
| Example 8 | (3) | (2) | PES-StAc | PES | Polyethylene | Ferrite particles | Silicone resin | 3.3 | 3.1 | B |
| Example 9 | | (4) | PES-StAc | PES | Polyethylene | Particles of resin in which magnetite particles are dispersed | Cyclohexyl methacrylate resin | 3.6 | 3.1 | C |
| Comparative example 4 | (5) | (1) | PES-StAc | PES | Polyethylene | Particles of resin in which magnetite particles are dispersed | Silicone resin | 3.6 | Beyond detection | D |
| Comparative example 5 | (3) | (3) | PES-StAc | PES | Polyethylene | Ferrite particles | Silicone resin | 4.5 | 3.1 | D |
| Example 10 | (6) | (1) | PES-StAc | PES-StAc | Paraffin | Particles of resin in which magnetite particles are dispersed | Silicone resin | 3.6 | 3.6 | A |
| Example 11 | (6) | (2) | PES-StAc | PES-StAc | Paraffin | Ferrite particles | Silicone resin | 3.3 | 3.6 | B |
| Example 12 | (6) | (4) | PES-StAc | PES-StAc | Paraffin | Particles of resin in which magnetite particles are dispersed | Cyclohexyl methacrylate resin | 3.6 | 3.6 | C |
| Comparative example 6 | (9) | (1) | PES-StAc | PES-StAc | Paraffin | Particles of resin in which magnetite particles are dispersed | Silicone resin | 3.6 | Beyond detection | D |
| Comparative example 7 | (6) | (3) | PES-StAc | PES-StAc | Paraffin | Ferrite particles | Silicone resin | 4.5 | 3.6 | D |
| Example 13 | (7) | (1) | PES | PES-StAc | Paraffin | Particles of resin in which magnetite particles are dispersed | Silicone resin | 3.6 | 2.7 | B |
| Example 14 | (7) | (2) | PES | PES-StAc | Paraffin | Ferrite particles | Silicone resin | 3.3 | 2.7 | B |
| Example 15 | (7) | (4) | PES | PES-StAc | Paraffin | Particles of resin in which magnetite particles are dispersed | Cyclohexyl methacrylate resin | 3.6 | 2.7 | C |
| Comparative example 8 | (7) | (3) | PES | PES-StAc | Paraffin | Ferrite particles | Silicone resin | 4.5 | 2.7 | D |
| Example 16 | (8) | (1) | PES-StAc | PES-StAc | Polyethylene | Particles of resin in which magnetite particles are dispersed | Silicone resin | 3.6 | 3.6 | A |
| Example 17 | (8) | (2) | PES-StAc | PES-StAc | Polyethylene | | Silicone resin | 3.3 | 3.6 | B |
| Example 18 | (8) | (4) | PES-StAc | PES-StAc | Polyethylene | Particles of resin in which magnetite particles are dispersed | Cyclohexyl methacrylate resin | 3.6 | 3.6 | B |
| Comparative example 9 | (10) | (1) | PES-StAc | PES-StAc | Polyethylene | Particles of resin in which magnetite particles are dispersed | Silicone resin | 3.6 | Beyond detection | D |
| Comparative example 10 | (8) | (3) | PES-StAc | PES-StAc | Polyethylene | Ferrite particles | Silicone resin | 4.5 | 3.6 | D |

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An electrostatic-image developer comprising:

a toner including toner particles, the toner particles including a binder resin, a release agent, and a non-ionic surfactant; and a resin-coated carrier including magnetic particles and a resin layer covering the magnetic particles, the resin-coated carrier having an absolute specific gravity of 3 $g/cm^3$ or more and 4 $g/cm^3$ or less.

2. The electrostatic-image developer according to claim 1, wherein the binder resin includes a modified amorphous polyester resin, the modified amorphous polyester resin being an amorphous polyester resin modified with at least one selected from a styrene and a (meth)acrylic acid ester.

3. The electrostatic-image developer according to claim 1, wherein the binder resin includes at least one selected from a crystalline polyester resin and a modified crystalline polyester resin, the modified crystalline polyester resin being a crystalline polyester resin modified with at least one selected from a styrene and a (meth) acrylic acid ester.

4. The electrostatic-image developer according to claim 1, wherein the resin layer includes a silicone resin.

5. The electrostatic-image developer according to claim 1, wherein the release agent includes a paraffin wax.

6. The electrostatic-image developer according to claim 1, wherein the amount of the non-ionic surfactant is, by mass, 0.5 ppm or more and 10 ppm or less of an amount of the resin-coated carrier.

7. The electrostatic-image developer according to claim 1, wherein the non-ionic surfactant is a compound including a polyoxyalkylene structure.

8. The electrostatic-image developer according to claim 7, wherein the non-ionic surfactant is a compound including a polyoxyethylene structure.

9. A process cartridge detachably attachable to an image forming apparatus, the process cartridge comprising:

the electrostatic-image developer according to claim 1; and a developing unit that develops an electrostatic image formed on a surface of an image holding member with the electrostatic-image developer to form a toner image.

* * * * *